US008245716B2

(12) United States Patent
Malvar et al.

(10) Patent No.: US 8,245,716 B2
(45) Date of Patent: Aug. 21, 2012

(54) FLOCKED COSMETIC APPLICATORS, METHODS OF MANUFACTURE AND DISPENSERS INCLUDING SUCH APPLICATORS

(75) Inventors: Michael Malvar, Oceanside, NY (US); Volker Schrepf, East Islip, NY (US); Thomas Jonas, New York, NY (US)

(73) Assignee: Albea Services, Genevilliers (FR)

( * ) Notice: Subject to any disclaimer, the term of this patent is extended or adjusted under 35 U.S.C. 154(b) by 424 days.

(21) Appl. No.: 11/900,166

(22) Filed: Sep. 10, 2007

(65) Prior Publication Data

US 2008/0060669 A1 Mar. 13, 2008

Related U.S. Application Data

(60) Provisional application No. 60/843,972, filed on Sep. 11, 2006.

(51) Int. Cl.
*A45D 40/26* (2006.01)

(52) U.S. Cl. ..... 132/218; 132/320

(58) Field of Classification Search ..... 132/216–218, 132/318, 320

See application file for complete search history.

(56) References Cited

U.S. PATENT DOCUMENTS

| | | | | |
|---|---|---|---|---|
| 4,135,527 | A | 1/1979 | Montiel | |
| 4,527,575 | A * | 7/1985 | Vasas | 132/218 |
| 5,357,987 | A | 10/1994 | Schrepf | |
| 5,765,573 | A | 6/1998 | Gueret | |
| 6,279,583 | B1 * | 8/2001 | Neuner | 132/218 |
| 6,295,994 | B1 * | 10/2001 | Thayer et al. | 132/218 |
| 7,069,936 | B2 * | 7/2006 | Gueret | 132/218 |
| 2003/0217759 | A1 * | 11/2003 | Kepka | 132/218 |
| 2004/0134507 | A1 * | 7/2004 | Gueret | 132/218 |
| 2005/0081874 | A1 * | 4/2005 | Mathiez | 132/218 |
| 2006/0032512 | A1 * | 2/2006 | Kress et al. | 132/218 |
| 2006/0225760 | A1 * | 10/2006 | Kearney | 132/218 |

OTHER PUBLICATIONS

"American Flock Association—What Is Flocking", 3 pages, <http://www.flocking.org>, Aug. 8, 2006.
"Flock-Flocking process—Understanding the Flocking Process", 6 pages, <http://www.swicofil.com>, Aug. 8, 2006.

* cited by examiner

*Primary Examiner* — Todd Manahan
*Assistant Examiner* — Brianne Kalach
(74) *Attorney, Agent, or Firm* — Cooper & Dunham LLP

(57) ABSTRACT

A cosmetic applicator for transporting and applying cosmetic material, including flocked applicators, a method for making applicators, and cosmetic dispensers including such applicators. The fibers of the flocking can vary in length, density, distribution and/or color.

14 Claims, 32 Drawing Sheets

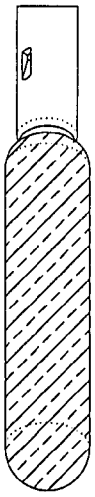
FIG. 10a
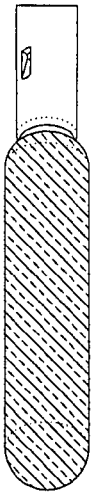
FIG. 10b
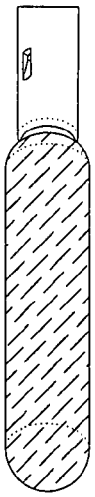
FIG. 10c
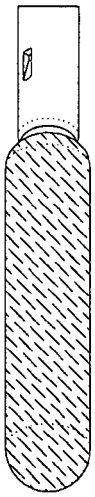
FIG. 10d
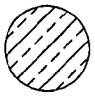
FIG. 10g
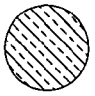
FIG. 10h
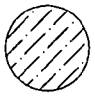
FIG. 10i
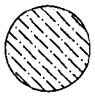
FIG. 10j
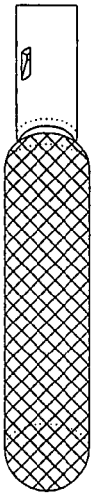
FIG. 10e
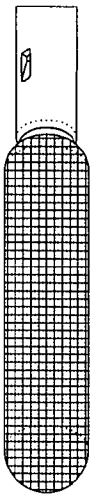
FIG. 10f
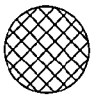
FIG. 10k
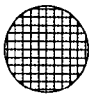
FIG. 10l
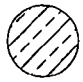
A
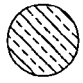
B
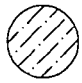
C
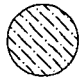
D
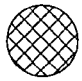
E
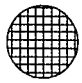
F

FLOCKED COSMETIC APPLICATORS, METHODS OF MANUFACTURE AND DISPENSERS INCLUDING SUCH APPLICATORS

CROSS-REFERENCE TO RELATED APPLICATIONS

This application claims the benefit of U.S. Provisional Application No. 60/843,972 filed Sep. 11, 2006, hereby incorporated by reference.

BACKGROUND OF THE INVENTION

This invention relates to cosmetic applicators of the type having an elongated core or stem and an applicator head constituted of an array of fibers carried by the core forming a brush for transporting and applying cosmetic material, to methods of making such applicators, and to cosmetic dispensers including them. In one specific sense, the invention is directed to flocked applicators, that is, applicators in which the brush head is constituted of a flocking.

For purposes of illustration, but without limitation, the invention will be particularly described with reference to applicators for mascara.

As shown in FIG. 1, a typical applicator 10 has an elongated core 12 with a multiplicity of fibers or bristles 14 attached to the core such that the bristles extend radially outwardly therefrom to form a brush fiber array 15 surrounding the core over a substantial portion of the length of the core to form the brush 16. Typically the fibers extend to the outer (distal) end 17 of the core. This combination of a core and a radiating array of fibers attached to the core provides a simple, low-cost and effective brush for application of cosmetic products.

Such applicators are well known and widely used in the cosmetics industry. Commonly, the proximal end of the brush is mounted in a receptacle in the threaded cap 18 or a stem rod 20 extending from the threaded cap 18 of a cosmetic product container, so that the brush projects into the container 22 when the cap is in container-closing position. Upon removal of the cap, the brush carries a quantity of cosmetic material, such as mascara, out of the container, and is manipulated to deliver and apply the product to the user's body, for example the user's eyelashes, the cap serving as a handle for the brush.

Conventional cosmetic brushes are frequently made of wire and bristle construction. The overall profile of a brush can be described as the notional envelope defined by the bristle extremities. For conventional brushes, this overall profile is most often cylindrical and/or smoothly tapering with progressively shorter bristles toward the distal end of the brush. Other bristle array profiles have been proposed, see for example U.S. Pat. No. 5,357,987, which shows, among other profiles, rectangular brush profiles; the entire disclosure of which is incorporated herein by this reference. However, such alternative bristle array patterns have not been applied to flocked cosmetic brushes.

Flocking is a process whereby a surface is covered with more or less densely packed, upstanding fibers, typically of short length and fine diameter. The fibers typically are delivered to an adhesive coating already applied to the surface. One flocking method utilizes electrostatic delivery of fibers to the adhesive coating, although other procedures may also be employed. In conventional flocked cosmetic brushes, the overall cylindrical and/or tapered profile of the brush fiber array is generally formed with an even distribution, density and length of fibers along the brush.

While flocked brushes have been used to apply cosmetic products, such brush arrays are not known to have been implemented for use with mascara. Additionally, because of the uniform length, density and distribution of fibers in conventional brushes, such brushes cannot vary the load of the cosmetic product which they carry. Since ease of use is important and because areas where cosmetic product is applied are often sensitive, the cosmetic brush must be able to both apply varied amounts of cosmetic product and provide a pleasant sensation when used.

SUMMARY OF THE INVENTION

An object of the present invention is to provide a new type of mascara brush that offers an improved, soft and luxurious feel when the user strokes the brush against one's eyelashes.

Another object of the present invention is to provide brushes for applying cosmetic material such as mascara, lip gloss, concealer or the like that have diverse applicator characteristics.

An additional object of the present invention is to provide a brush for applying cosmetic material such as mascara or the like combining within a single structure diverse applicator characteristics respectively suited to the performance of specifically different functions in the application of the cosmetic material and capable of being enclosed within a container of the material when not in use.

Yet another object of the present invention is to provide a flocked mascara brush.

A further object of the present invention is to provide a way to temporarily or permanently change the profile and application effects of cosmetic brushes.

A still further object of the present invention is to provide a way to manufacture cosmetic brushes wherein the brush fibers are arranged in different patterns which may be visually attractive and can be used for marketing purposes.

To these and other ends, the present invention broadly contemplates the provision of a cosmetic brush having an elongated core and an array of fibers projecting outwardly therefrom, the fibers being flocked to the core, for example by electrostatic delivery of fibers to an adhesive coating located on the core. However, other methods of flocking may also be used. While the fibers generally consist of soft, light material, stiffer fibers such as bristles may also be flocked. The fiber array of the present invention has a proximal end and a distal end spaced apart along the linear axis with the tips of the fibers of the array defining a notional envelope, wherein the fibers are not necessarily of equal length, density distribution and/or color, such that various patterns of fibers can be formed on the core. The proximal end of the core may be a stem or engage an end of a stem having an opposite end secured within a handle, such as a mascara container cap. When the core for a cosmetic applicator is made of a flexible material, such as can be employed by the present invention, the core also can be referred to as a flexer.

Additionally, the invention may be embodied in a brush for applying mascara wherein the flocked fibers are of uniform length, density, distribution and/or color along the core.

Further, in accordance with the invention, the transverse cross-section of the envelope can be substantially uniform in dimensions along at least a major portion of the envelope. Also, the envelope can taper toward the distal end of the array, and the aforesaid major portion of the envelope advantageously has extended longitudinal edges parallel to the linear axis of the core.

In another embodiment of the invention, the elongated core consists of non-cylindrical shapes which provide benefits when applying cosmetic-products.

In a further embodiment of the present invention, the applicator can be covered with outer sleeves or coatings that will further change the profile and application effects of the brush. These sleeves or coatings may be flocked, contain bristles, or remain bare.

In another embodiment of the invention, the flocked material may be attached to the core which is rotatably connected to a connector, which is fixedly connected to a handle or stem rod, such that the brush will rotate as cosmetic product is applied by the user.

In an additional embodiment of the present invention, the numerous new arrays of fibers can be incorporated into a traditional wire and bristle mascara brush so that these arrays provide new mascara application functions.

In another embodiment of the present invention, cosmetic brushes can be manufactured by selectively dying fibers in different colors so that they are visually attractive and may serve marketing purposes such as displaying brand logos.

The varied shapes of the brushes of the present invention offer the consumer the quick and easy application that the user demands, yet there is no special skill or newly-learned technique involved in using these brushes. Additionally, the use of flocked brushes for applying mascara provides the user with a soft and luxurious sensation when applying the product to one's lashes that cannot be obtained with conventional wire brushes. Finally, the use of sleeves allows the user to temporarily or permanently change the characteristics of the brush to further customize the application of cosmetic products.

BRIEF DESCRIPTION OF THE DRAWINGS

FIGS. 10*a*, 10*b*, 10*c*, 10*d*, 10*e* and 10*f* are perspective views, and FIGS. 10*g*, 10*h*, 10*i*, 10*j*, 10*k*, and 10*l* are respective top views, of a cosmetic brush embodying the present invention having colored flocking of yellow, orange, light green, dark green, light blue and dark blue, respectively;

DETAILED DESCRIPTION OF THE PREFERRED EMBODIMENT

Figure 1:
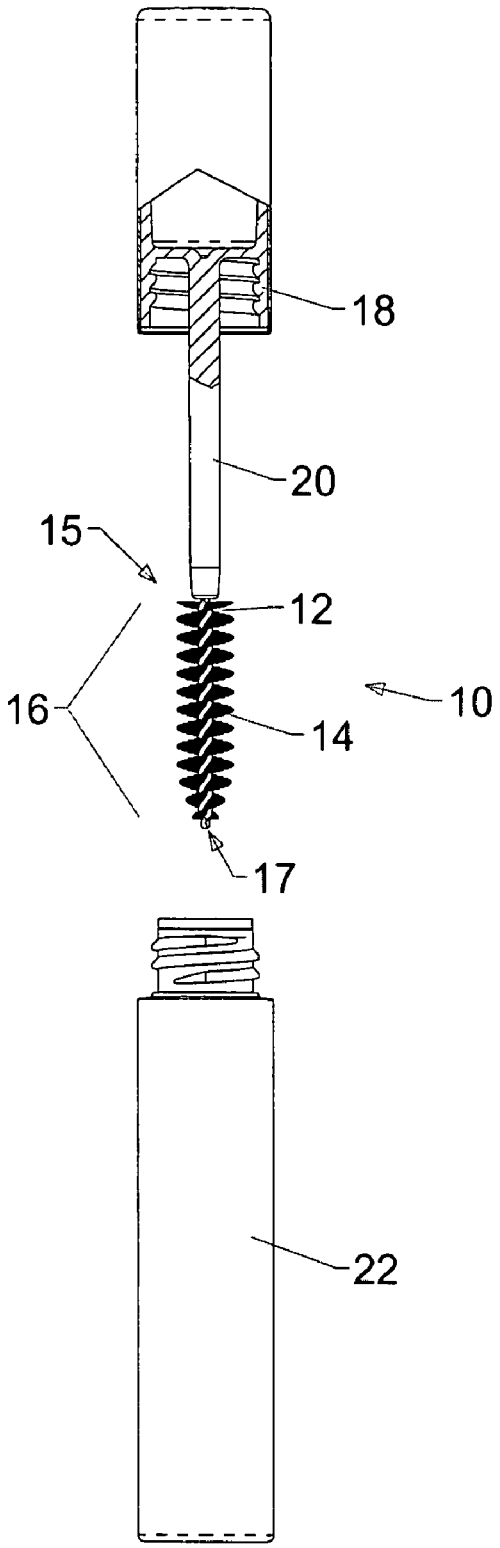
FIG. 1 (Prior Art)
FIG. 1 is a partial cross-sectional side view of a conventional mascara brush and container.
Figure 2:
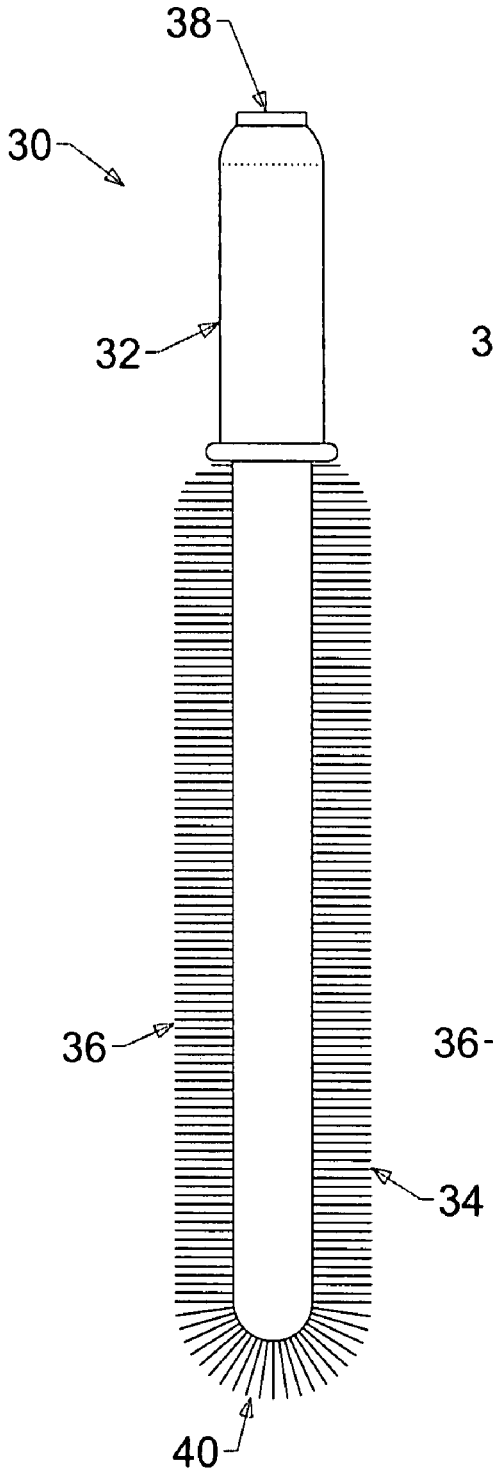
FIG. 2 is a side view of an embodiment of the present invention showing individual fibers of the flocking adhered to a core.
Figure 3A:
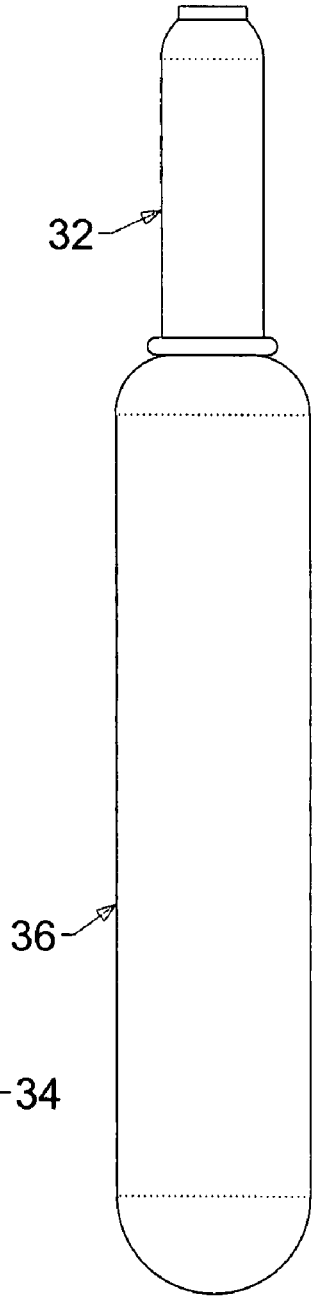
FIGS. 3*a* and 3*b* are a side view and cross sectional side view, respectively, of a cosmetic brush embodying the present invention in a particular form showing flocking adhered to a core.
Figure 3B:
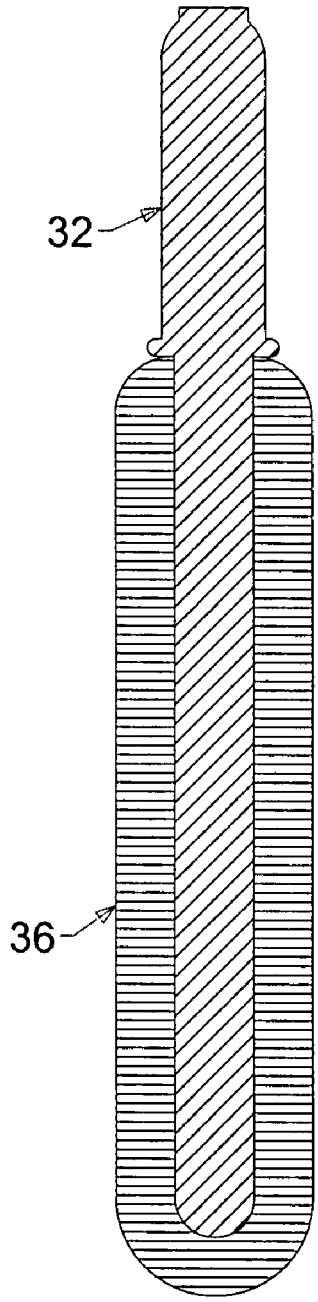
Figure 4A:
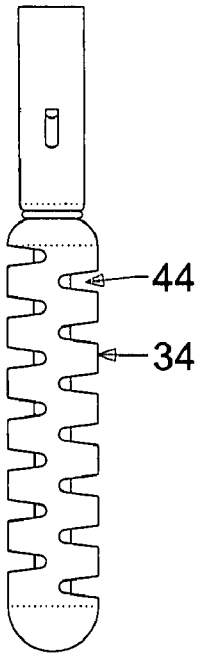
FIGS. 4*a* and 4*e* are a side view and a front view, respectively, of a cosmetic brush embodying the present invention in a particular form having alternating partial transverse rings.
Figure 4B:
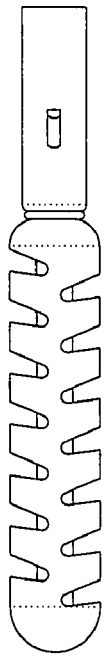
FIGS. 4*b* and 4*f* are a side view and a front view, respectively, of a cosmetic brush embodying the present invention in a particular form having alternating partial oblique rings (wedges)
Figure 4C:
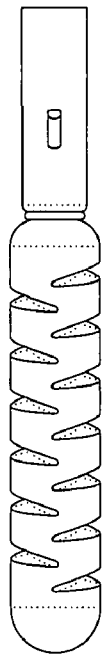
FIGS. 4*c* and 4*g* are a side view and a front view, respectively, of a cosmetic brush embodying the present invention in a particular form having alternating partial spirals.
Figure 4D:
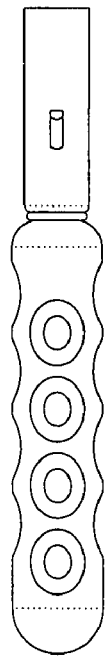
FIGS. 4*d* and 4*h* are a side view and a front view, respectively, of a cosmetic brush embodying the present invention in a particular form having multiple holes.
Figure 4E:
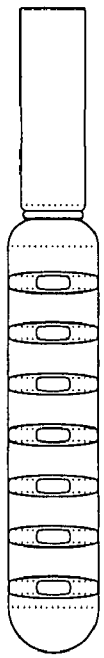
Figure 4F:
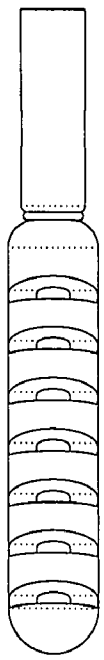
Figure 4G:
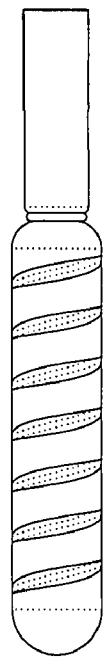
Figure 4H:
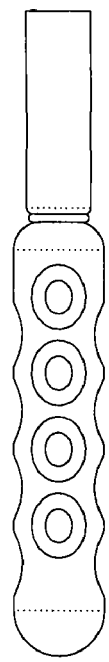
Figure 5A:
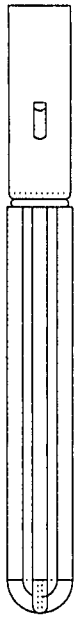
FIGS. 5*a* and 5*e* are a front view and a top view, respectively, of a cosmetic brush core embodying the present invention in a particular form showing multiple longitudinal masks on the bare core.
Figure 5B:
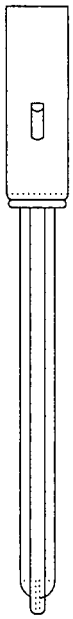
FIGS. 5*b* and 5*f* are a front view and a top view, respectively, of a cosmetic brush core embodying the present invention in a particular form showing two longitudinal masks on the bare core.
Figure 5C:
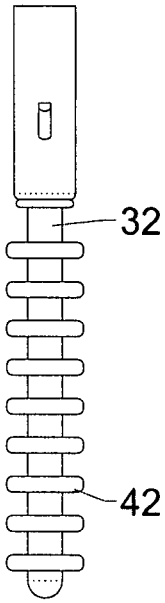
FIGS. 5*c* and 5*g* are a front view and a top view, respectively, of a cosmetic brush core embodying the present invention in a particular form showing multiple transverse masks on the bare core.
Figure 5D:
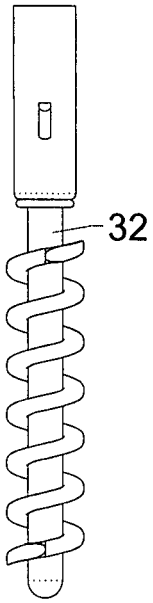
FIGS. 5*d* and 5*h* are a front view and a top view, respectively, of a cosmetic brush core embodying the present invention in a particular form showing a helical mask on the bare core.
Figure 5E:
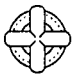
Figure 5F:
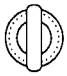
Figure 5G:
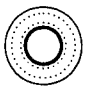
Figure 5H:
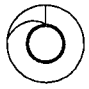
Figure 6A:
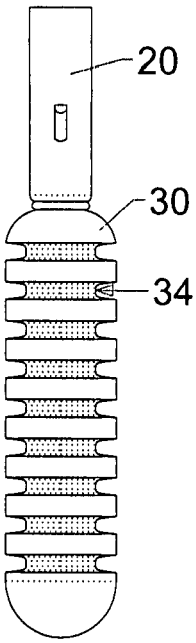
FIGS. 6*a* and 6*c* are a side view and a cross-sectional view, respectively, of a cosmetic brush embodying the present invention in a particular form having transverse regions of different flocking envelope thicknesses.
Figure 6C:
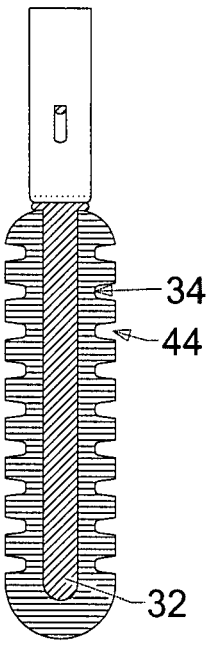
Figure 6B:
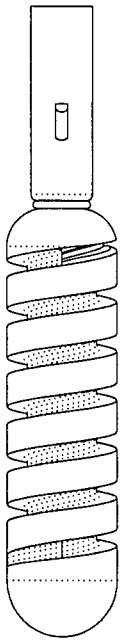
FIGS. 6*b* and 6*d* are a side view and a cross-sectional view, respectively, of a cosmetic brush embodying the present invention in a particular form having helical regions of different flocking envelope thicknesses.
Figure 6D:
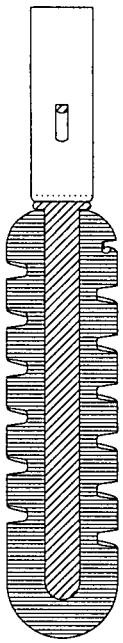
Figure 7A:
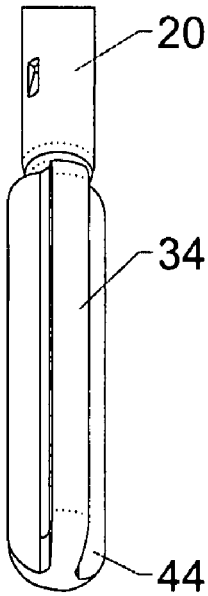
FIGS. 7*a* and 7*e* are a perspective view and a top view, respectively, of a cosmetic brush embodying the present invention in a particular form having three flat longitudinal regions.
Figure 7B:
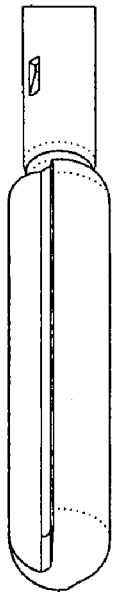
FIGS. 7*b* and 7*f* are a perspective view and a top view, respectively, of a cosmetic brush embodying the present invention in a particular form having two flat longitudinal regions.
Figure 7C:
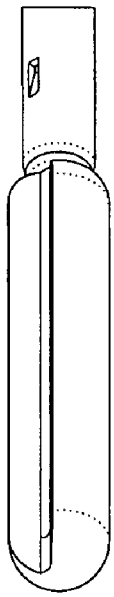
FIGS. 7*c* and 7*g* are a perspective view and a top view, respectively, of a cosmetic brush embodying the present invention in a particular form having one flat longitudinal region.
Figure 7D:
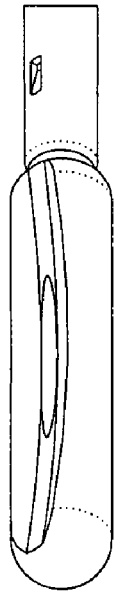
FIGS. 7*d* and 7*h* are a perspective view and a top view, respectively, of a cosmetic brush embodying the present invention in a particular form having a tapered partial longitudinal region.
Figure 7E:
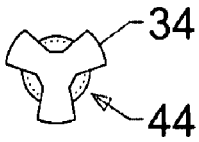
Figure 7F:
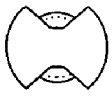
Figure 7G:
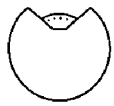
Figure 7H:
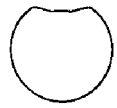
Figure 8A:
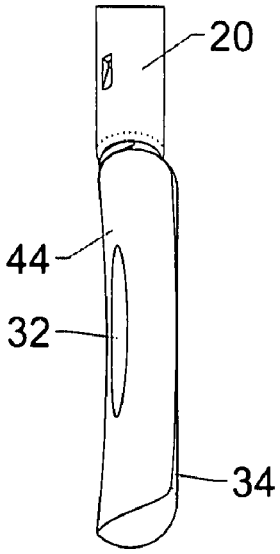
FIG. 8*a* is a perspective view of a cosmetic brush embodying the present invention in a particular form having a tapered longitudinal region.
Figure 8B:
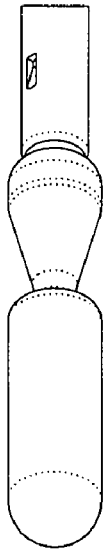
FIG. 8*b* is a perspective view of a cosmetic brush embodying the present invention in a particular form having a tapered transverse region proximate the proximal end.
Figure 8C:
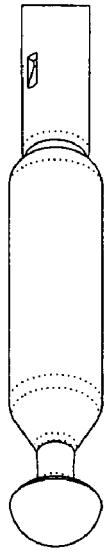
FIG. 8*c* is a perspective view of a cosmetic brush embodying the present invention in a particular form having a tapered transverse region proximate the distal end.
Figure 8D:
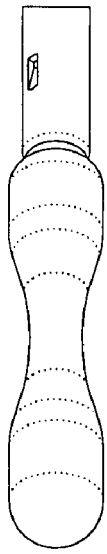
FIG. 8*d* is a perspective view of a cosmetic brush embodying the present invention in a particular form having a wide, shallow tapered transverse region.
Figure 8E:
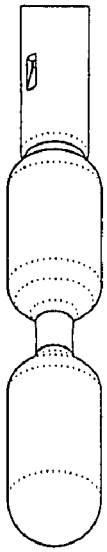
FIG. 8*e* is a perspective view of a cosmetic brush embodying the present invention in a particular form having a wide, deep tapered transverse region.
Figure 8F:
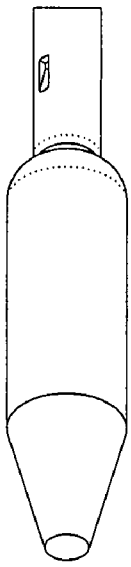
FIG. 8*f* is a perspective view of a cosmetic brush embodying the present invention in a particular form having a tapered tip region.
Figure 8G:
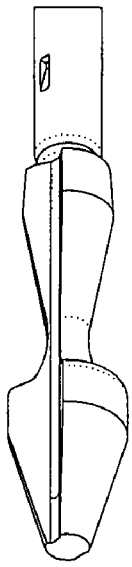
FIG. 8*g* is a perspective view of a cosmetic brush embodying the present invention in a particular form having a wide, tapered transverse region and a longitudinal groove.
Figure 9A:
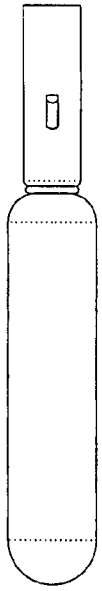
FIGS. 9*a* and 9*h* are a side view and a top view, respectively, of a cosmetic brush embodying the present invention in a particular form made without trimming.
Figure 9B:
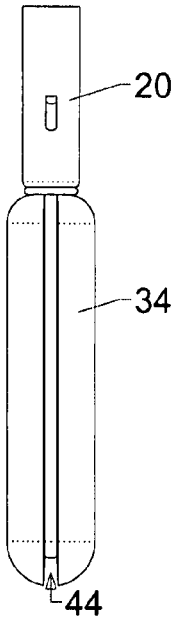
FIGS. 9*b* and 9*i* are a side view and a top view, respectively, of a cosmetic brush embodying the present invention in a particular form having two longitudinal grooves.
Figure 9C:
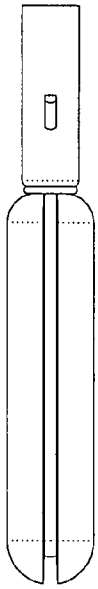
FIGS. 9*c* and 9*j* are a side view and a top view, respectively, of a cosmetic brush embodying the present invention in a particular form having four longitudinal grooves.
Figure 9D:
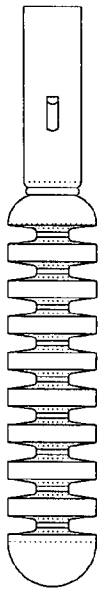
FIGS. 9*d* and 9*k* are a side view and a top view, respectively, of a cosmetic brush embodying the present invention in a particular form having multiple transverse rings.
Figure 9H:
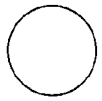
Figure 9I:
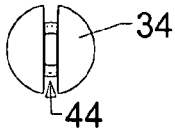
Figure 9J:
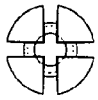
Figure 9K:
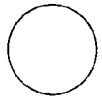
Figure 9E:
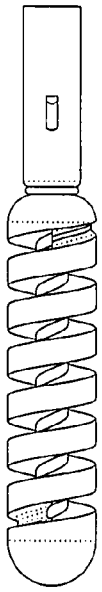
FIGS. 9*e* and 9*l* are a side view and a top view, respectively, of a cosmetic brush embodying the present invention in a particular form having spiral grooves.
Figure 9F:
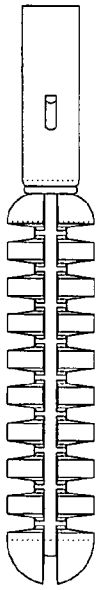
FIGS. 9*f* and 9*m* are a side view and a top view, respectively, of a cosmetic brush embodying the present invention in a particular form having both multiple transverse rings and crossing longitudinal grooves.
Figure 9G:
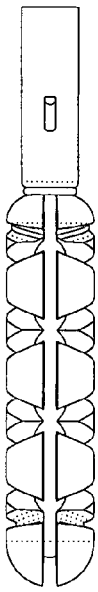
FIGS. 9*g* and 9*n* are a side view and a top view, respectively, of a cosmetic brush embodying the present invention in a particular form having crossing spiral grooves and a longitudinal groove.
Figure 9L:
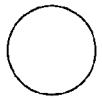
Figure 9M:
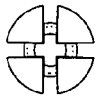
Figure 9N:
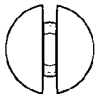
Figure 11A:
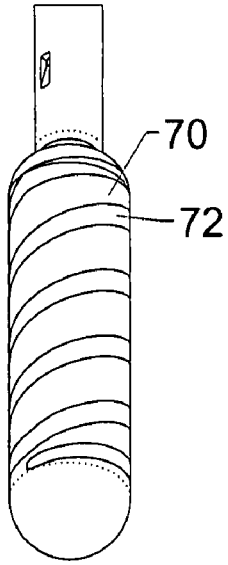
FIGS. 11*a*, 11*b*, 11*c*, 11*d*, 11*e*, 11*f*, 11*g*, 11*h*, 11*i*, 11*j*, 11*k*, 11L and 11*m* are perspective views of cosmetic brushes embodying the present invention in a particular form having various patterned regions including spiral, multiple transverse rings, multiple longitudinal, single longitudinal, dots, partial spirals, dotted longitudinal, bulls-eye, S-shaped, X-shaped, longitudinal and transverse, wide spiral, and partial longitudinal, respectively.
Figure 11B:
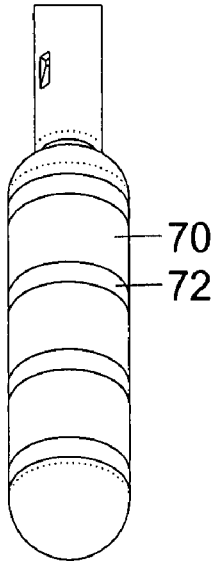
Figure 11C:
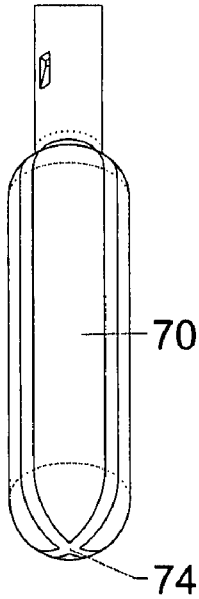
Figure 11D:
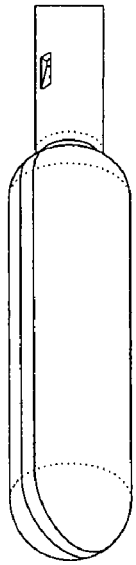
Figure 11E:
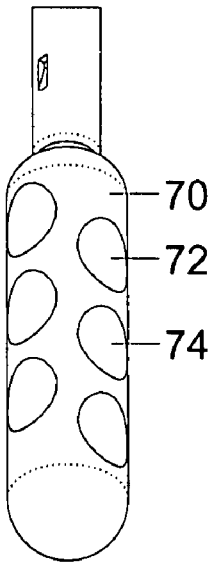
Figure 11F:
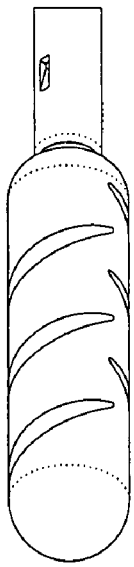
Figure 11G:
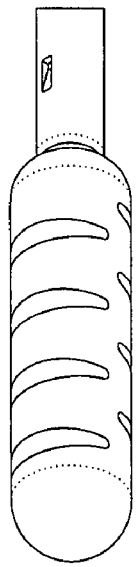
Figure 11H:
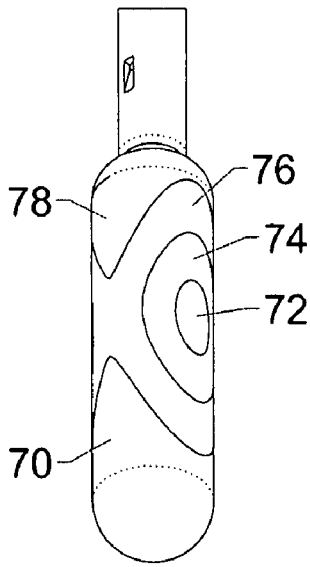
Figure 11I:
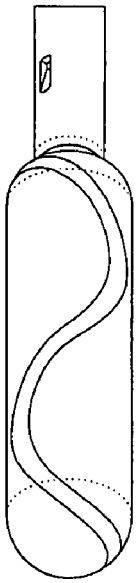
Figure 11J:
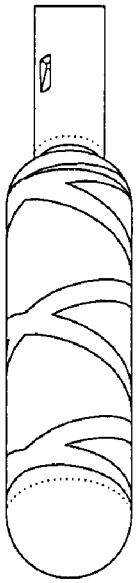
Figure 11K:
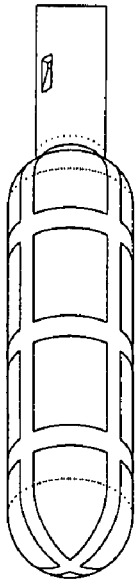
Figure 11L:
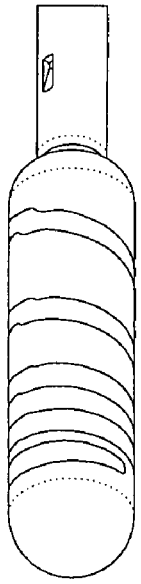
Figure 11M:
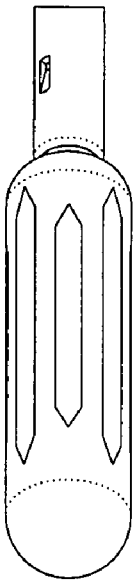

Referring to FIGS. 2, 3*a* and 3*b*, one embodiment of the invention provides a brush 30 comprising an elongated core 32 which can be constituted of plastic, metal or other suitable material, and a multiplicity of fibers 34, for example nylon fibers, attached to the core 32 and extending radially outwardly therefrom to form a brush fiber array 36 surrounding the core over a substantial portion of the length of the core. The fibers 34 can be attached to the core 32 by first applying an adhesive to a portion of the surface of the core 32 and then applying the fibers 34 onto the core, preferably by electrostatic delivery. The manufacture and arrangement of such flocked structures are well known in the art, and accordingly need not be further described. The core 32 has a proximal end 38 and a distal end 40 to which the fiber array extends. The proximal end of the fiber array 36 being spaced distally from the proximal end 38 of the core so as to leave an exposed proximal length of the core for mounting in a handle, such as the stem rod of a mascara container cap. Such an applicator will provide a continuous uniform fiber array as shown in FIG. 9*a*.

In accordance with other embodiments of the present invention and as shown in FIGS. 5*a*-5*h*, after an adhesive is applied to core 32 but before the fibers 34 are flocked to the core, a mask or masks 42 having a desired pattern can be placed over the core so that fibers will not adhere to the masked portions. Accordingly, as shown in FIGS. 4*a*-4*h* when the fibers 34 are flocked, the fibers adhere to the unmasked portions only thereby creating a brush with voids 44. Numerous desirable patterns embodying voids can be created in this manner. Alternatively, the adhesive can be applied after the mask is placed over a bare core, the mask can then be removed, and the fibers will only be flocked to the portion of the core having adhesive.

As shown in FIGS. 30-36, masks can also be sleeves or coverings 204 which are used before or after flocking but can remain around the core 202 for end use.

As shown in FIGS. 31, 33, 35*a*, and 35*b*, after the flocking 206 is adhered to the core 202, a sleeve 204 is injection molded onto at least a portion of the flocking 206 thereby covering the fibers in the masked region. Trimming can also be performed in the flocking before and/or after the sleeve 204 is injection molded.

Figure 32:
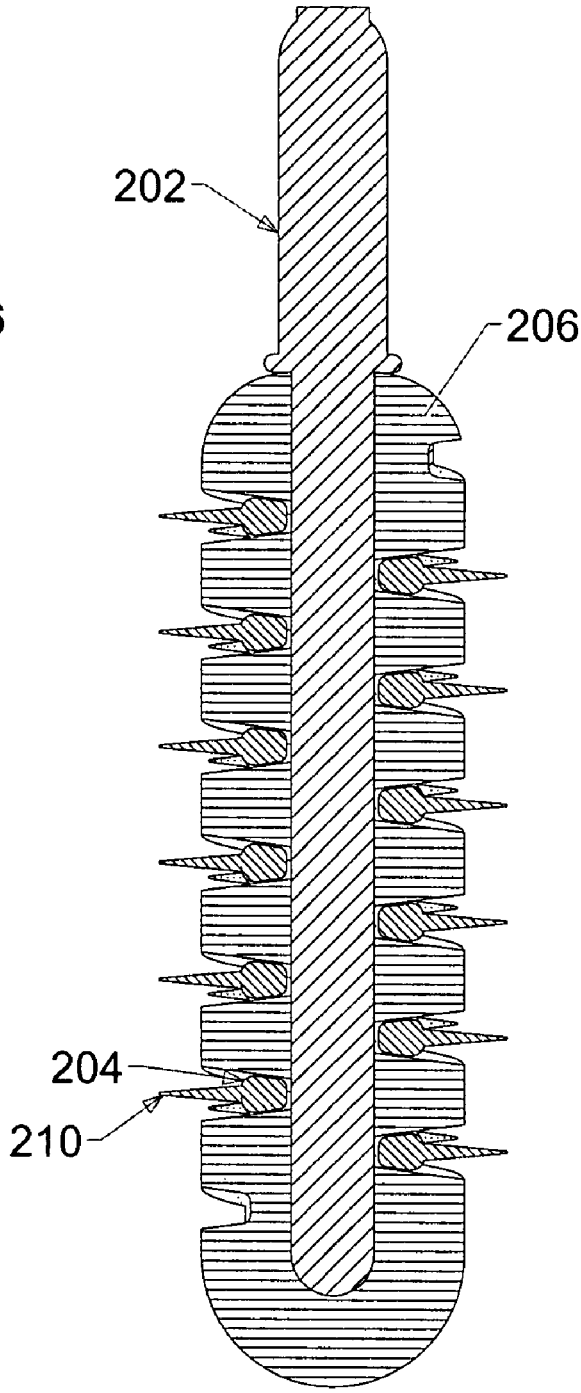
FIG. 32 is a cross-sectional view of an embodiment of the present invention showing a sleeve with bristles placed over a flocked core.
Figure 34:
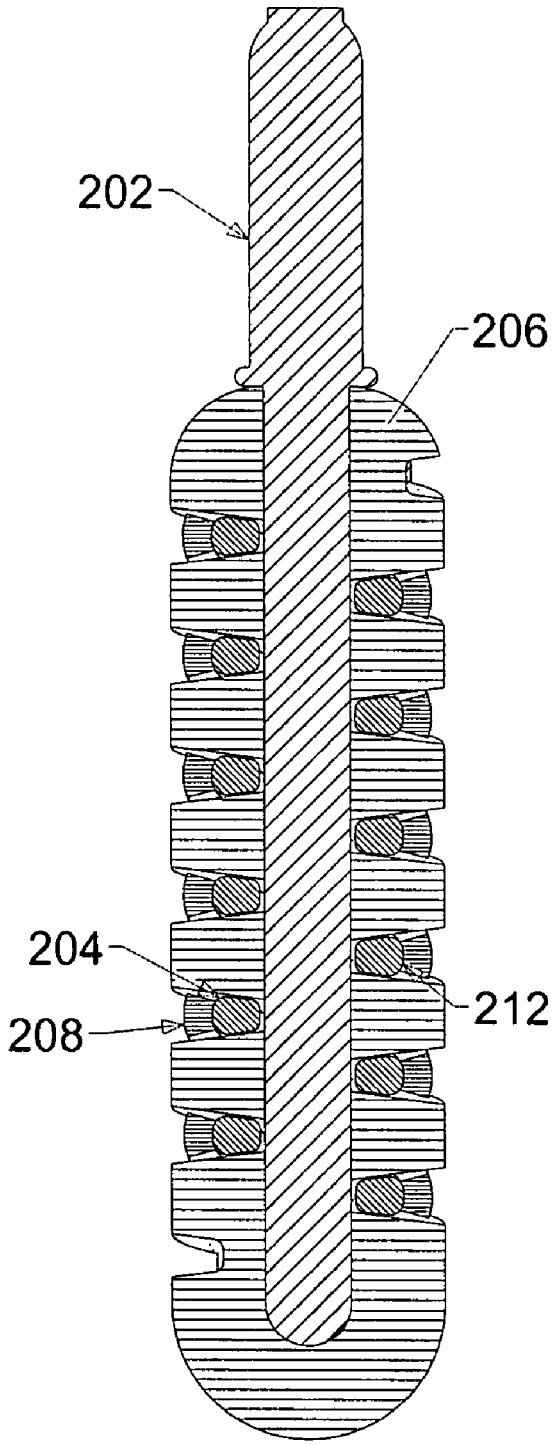
FIG. 34 is a cross-sectional view of an embodiment of the present invention showing a sleeve with flocking placed over a flocked core.
Figure 35A:
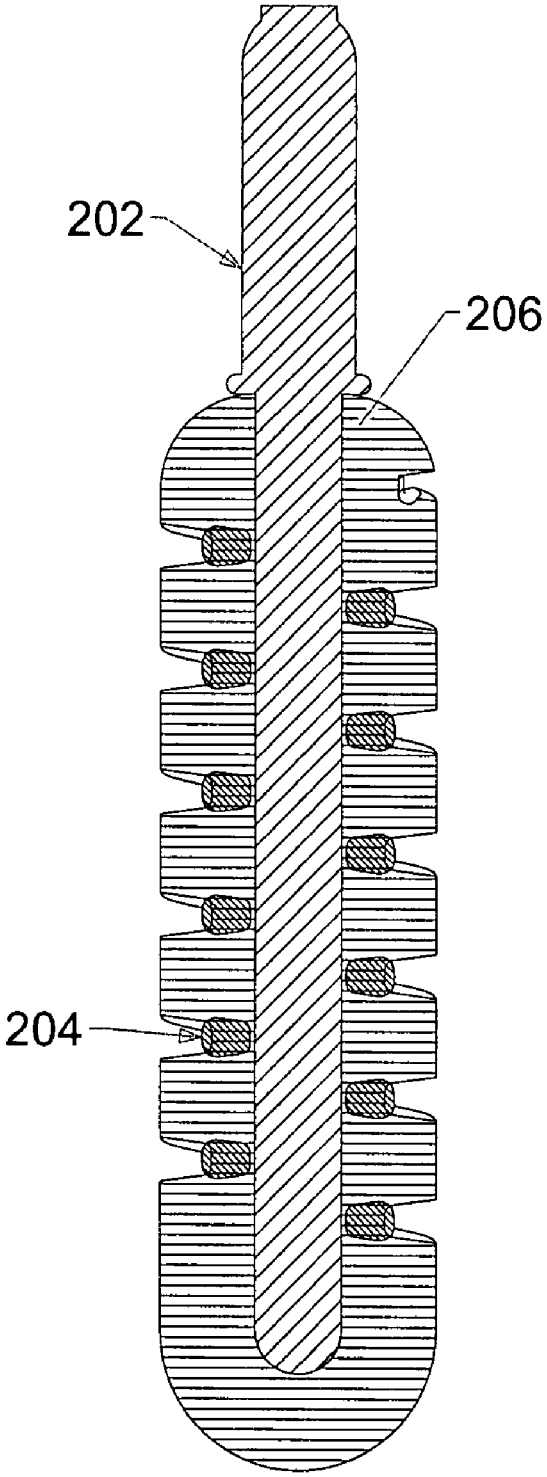
FIGS. 35*a* and 35*b* are a cross-sectional view and a corresponding enlargement, respectively, of an embodiment of the present invention showing a sleeve injection molded over a flocked core.
Figure 35B:
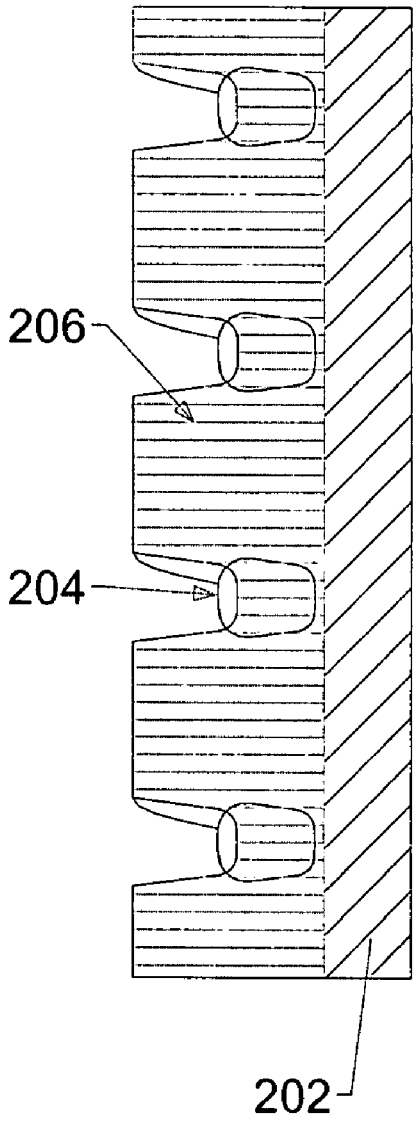
Figure 36:
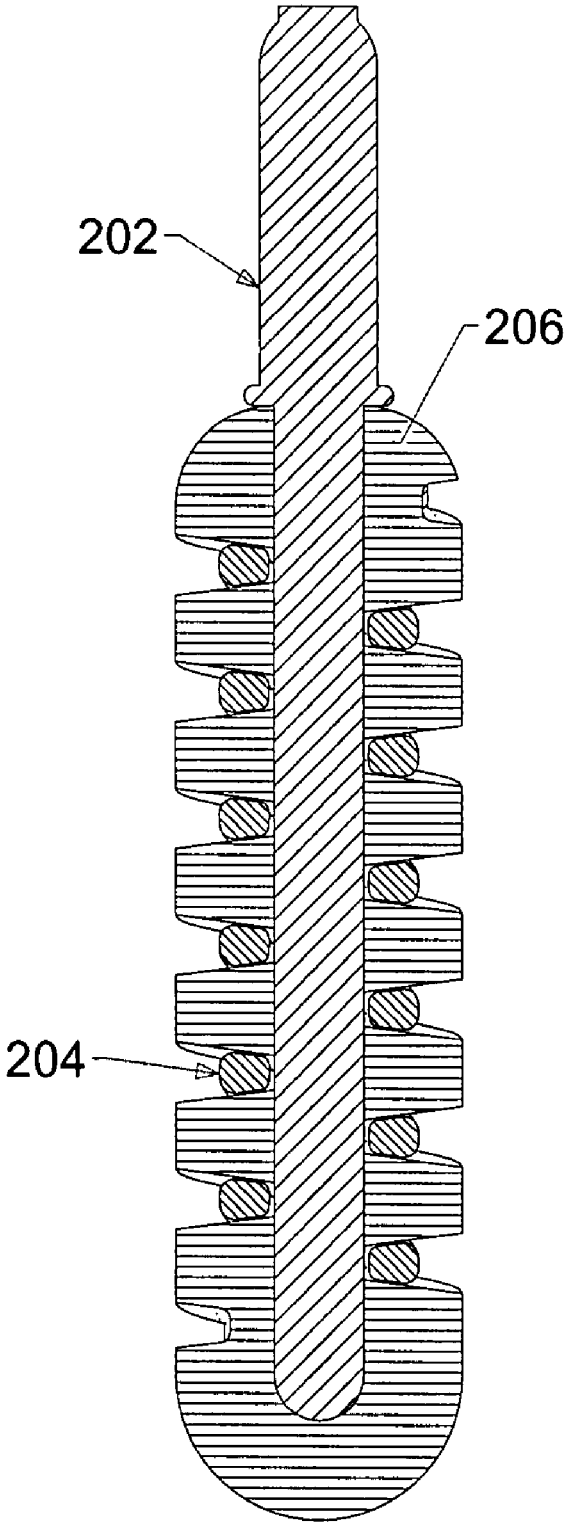
FIG. 36 is a cross-sectional view of an embodiment of the present invention showing a sleeve placed over a flocked core.

In an alternative embodiment, as shown in FIGS. 32, 34, and 36, a separately formed sleeve 204 can be assembled or placed over the flocked core 202. In this embodiment, the fibers can be covered and/or redirected from the masked regions to the unmasked regions. Trimming can also be performed on the flocking before and/or after the sleeve 204 is placed.

Figure 31:
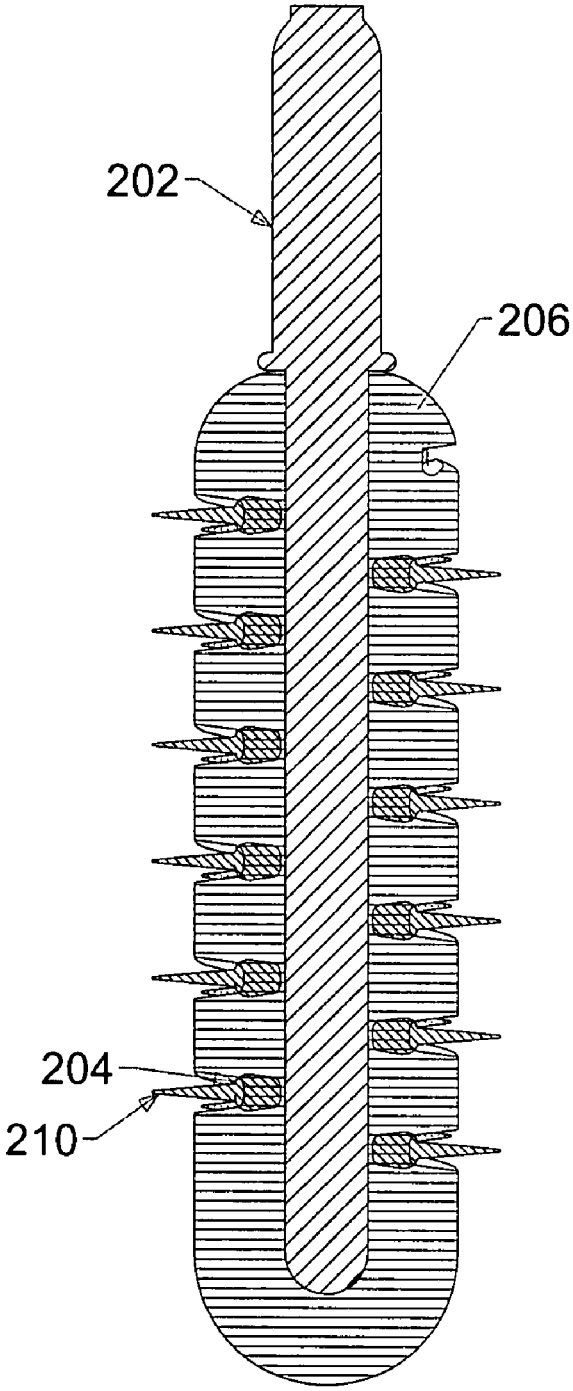
FIG. 31 is a cross-sectional view of an embodiment of the present invention showing a sleeve with bristles injection molded over a flocked core.
Figure 33:
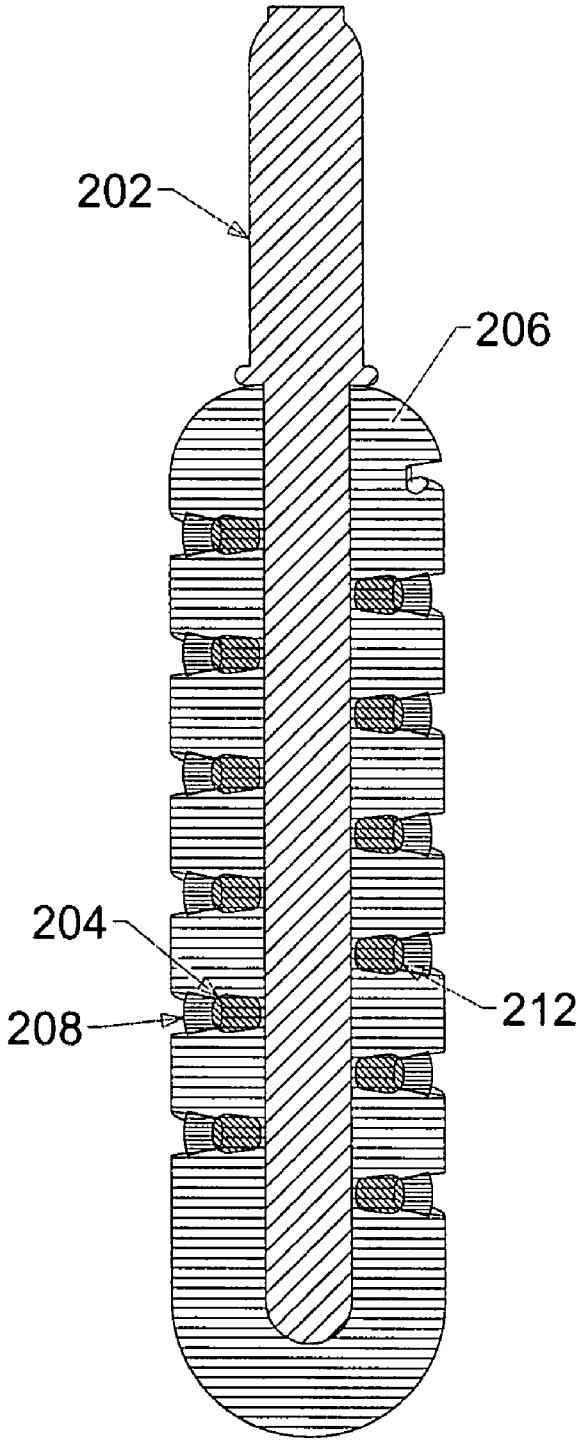
FIG. 33 is a cross-sectional view of an embodiment of the present invention showing a sleeve with flocking injection molded over a flocked core.

The sleeves 204 can be detachable or removable, fixed to the core 202 or the flocking 206, or adhered to the core or the flocking. A user may be directed to remove the sleeve 204 before use. Also, as shown in FIGS. 33 and 34, the sleeves or coverings can be separately flocked 208, and/or, as shown in FIGS. 31 and 32, be injection molded to have bristles 210.

When the fibers 14 of a conventional brush are initially attached to the core 12, their free ends may project for somewhat randomly unequal distances therefrom, and accordingly the brush can be subjected to a trimming step. To produce brushes of conventional round, that is cylindrical and/or tapering conical, profile, such brushes are rotated through trimmer heads.

While such trimming is common in the manufacture of conventional twisted-in-wire brushes, one embodiment of the present invention employs trimming to create voids 44 in the flocked fiber array 36 such that the voids form patterns. As shown in FIGS. 7*a*-7*h* and 8*a*-8*g*, the fibers 34, after being applied in uniform density along the core 32, can be trimmed into a desired pattern.

While the patterns of FIGS. 4*a*-4*h* were made using masks 42 and the patterns of FIGS. 7*a*-7*h* and 8*a*-8*g* were made by trimming, most patterns can be made by either method alone, or by a combination of the two. Compare for example FIGS. 9*b*-9*g* and 9*i*-9*n* which were made by trimming and FIGS. 5*a*-5*h* which show masks 42 for similar patterns.

One example of combining masking and trimming is shown in FIGS. 6*a*-*d* where masks 42 were applied to the brush 30 on top of the fibers 34 to create a desired void pattern after the fibers 34 had been attached to the core 32, at which point an additional flocking was applied. However, these patterns could have also been made by thickly flocking the entire brush 30 and then trimming certain regions.

Once void patterns are created, the voids can be left bare, or a different type of fiber, such as fibers having different densities, lengths, colors, textures, stiffness, composition, etcetera can be attached to the masked regions by applying additional adhesive on such regions and then flocking on the different type of fibers. By applying two or more types of fiber, a cosmetic brush with more diverse application properties can be created. Also, complex patterns, such as corporate logos, can be created in the fiber array 36 using this technique. Complex patterns are beneficial because they can be visually attractive and can be employed to visually identify the characteristics of the brush.

As shown in FIGS. 10*a*-10*l*, single colored brushes can also be manufactured by dipping the flocked brush, wholly or partially, into a suitable dye or other colorant so that, all of or some of, the fibers on the brush are made to be the same color. The brushes shown in FIGS. 10*a*-10*l* are represented by hatching to indicate examples of different colors, for example, yellow A, orange B, light green C, dark green D, light blue E, and dark blue F.

However, as shown in FIGS. 11*a*-11*m*, complex patterns can also be created by masking a flocked core and then applying a dye or other colorant to the core to effectively 'print' a pattern. Exemplary printing processes include: masking, such as silk-screening; direct painting; and/or spraying, such as with ink-jet printing techniques. Alternatively, instead of dye, a thin layer of additional flocking of a contrasting visual type, such as different colors, textures, diameters, etcetera can be applied to create the pattern. Also, multiple colors and/or flockings 72, 74, 76, 78 can be used to impart a pattern over a background color or flocking 70.

Furthermore, the adhesive or epoxy, which adheres the flocking to the core, can also be colored. With this process, the core, the adhesive, and the flocking can each be different colors. This difference in colors allows for multicolor patterns to be made during the trimming process by selectively trimming through the flocking and/or adhesive to expose the different color or colors of the adhesive and/or the core. This invention contemplates that the diverse patterning processes discussed above can be combined in various combinations to produce complex, multi-color and/or multi-textural patterns for a brush.

Figure 12A:
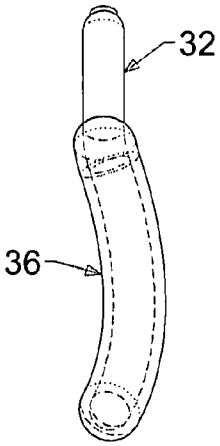
FIG. 12*a* is a perspective view of a cosmetic brush embodying the present invention in a particular form having a slight hook at the distal end of the core.
Figure 13A:
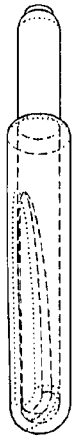
FIG. 13*a* is a perspective view of a cosmetic brush embodying the present invention in a particular form having a partial concave tapering region at the distal end of the core.
Figure 14A:
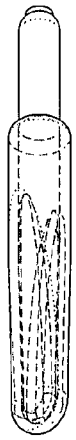
FIG. 14*a* is a perspective view of a cosmetic brush embodying the present invention in a particular form having two opposing partial concave tapering regions at the distal end of the core.
Figure 15A:
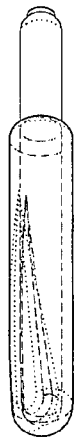
FIG. 15*a* is a perspective view of a cosmetic brush embodying the present invention in a particular form having a partial tapering region on one side at the distal end of the core.
Figure 16A:
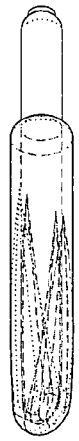
FIG. 16*a* is a perspective view of a cosmetic brush embodying the present invention in a particular form having two opposing partial tapering regions at the distal end of the core.
Figure 12B:
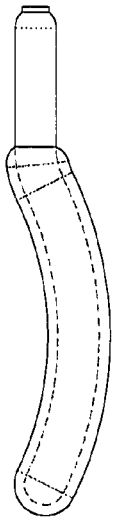
FIG. 12*b* is a side view of FIG. 12*a;*
Figure 13B:
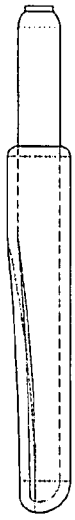
FIG. 13*b* is a side view of FIG. 13*a;*
Figure 14B:
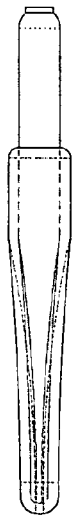
FIG. 14*b* is a side view of FIG. 14*a;*
Figure 15B:
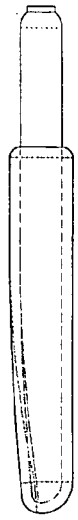
FIG. 15*b* is a side view of FIG. 15*a;*
Figure 16B:
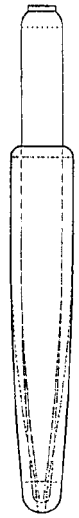
FIG. 16*b* is a side view of FIG. 16*a;*
Figure 17A:
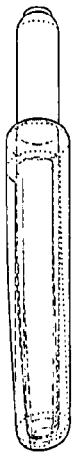
FIG. 17*a* is a perspective view of a cosmetic brush embodying the present invention in a particular form having a tapering region terminating at a flat distal end of the core.
Figure 18A:
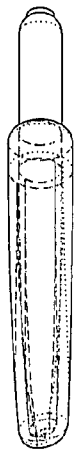
FIG. 18*a* is a perspective view of a cosmetic brush embodying the present invention in a particular form having a tapering region terminating at a flat distal end of the core.
Figure 19A:
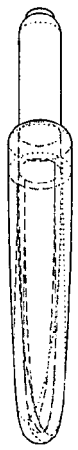
FIG. 19*a* is a perspective view of a cosmetic brush embodying the present invention in a particular form having a tapering region terminating at a rounded distal end of the core.
Figure 20A:
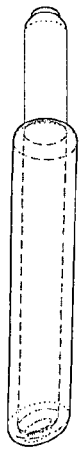
FIG. 20*a* is a perspective view of a cosmetic brush embodying the present invention in a particular form having slight tapering regions at the distal end of the core.
Figure 21A:
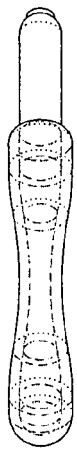
FIG. 21*a* is a perspective view of a cosmetic brush embodying the present invention in a particular form having an hourglass shape at the distal end of the core.
Figure 17B:
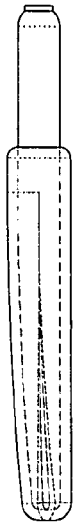
FIG. 17*b* is a side view of FIG. 17*a;*
Figure 18B:
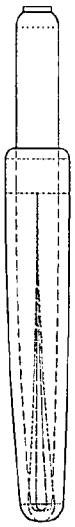
FIG. 18*b* is a side view of FIG. 18*a;*
Figure 19B:
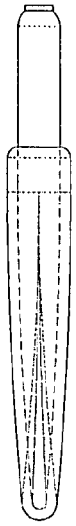
FIG. 19*b* is a side view of FIG. 19*a;*
Figure 20B:
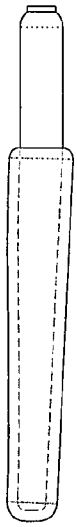
FIG. 20*b* is a side view of FIG. 20*a;*
Figure 21B:
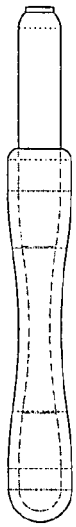
FIG. 21*b* is a side view of FIG. 21*a;*
Figure 22A:
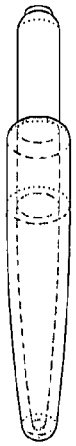
FIG. 22*a* is a perspective view of a cosmetic brush embodying the present invention in a particular form having a tapering region terminating at a rounded tip at the distal end of the core.
Figure 23A:
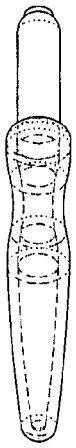
FIG. 23*a* is a perspective view of a cosmetic brush embodying the present invention in a particular form having a pinched cone shape at the distal end of the core.
Figure 24A:
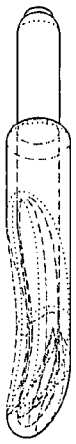
FIG. 24*a* is a perspective view of a cosmetic brush embodying the present invention in a particular form having sharp hook at the distal end of the core.
Figure 25A:
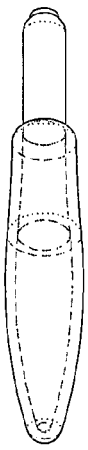
FIG. 25*a* is a perspective view of a cosmetic brush embodying the present invention in a particular form having a bulb-shaped distal end.
Figure 26A:
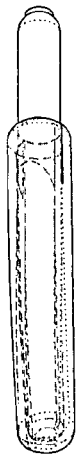
FIG. 26*a* is a perspective view of a cosmetic brush core embodying the present invention in a particular form having a partial tapering region terminating in a flat distal end.
Figure 22B:
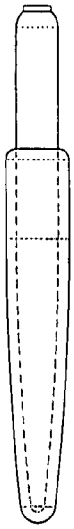
FIG. 22*b* is a side view of FIG. 22*a;*
Figure 23B:
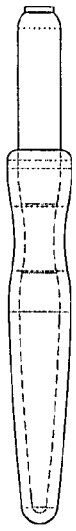
FIG. 23*b* is a side view of FIG. 23*a;*
Figure 24B:
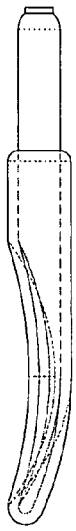
FIG. 24*b* is a side view of FIG. 24*a;*
Figure 25B:
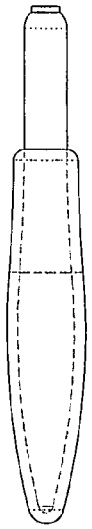
FIG. 25*b* is a side view of FIG. 25*a;*
Figure 26B:
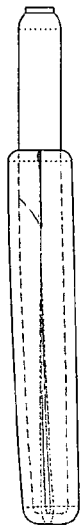
FIG. 26*b* is a side view of FIG. 26*a;*
Figure 27A:
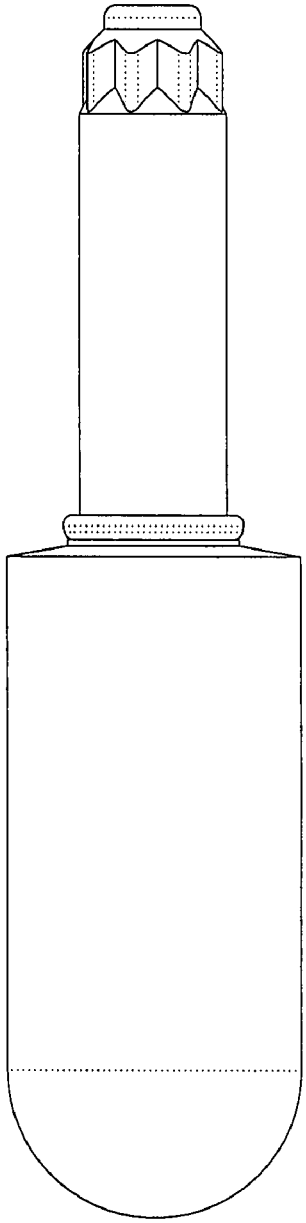
FIGS. 27*a* and 27*b* are a side view and a cross-sectional side view, respectively, of a cosmetic brush embodying the present invention in a particular form showing a hollow core with flocking attached to a removable connector.
Figure 27B:
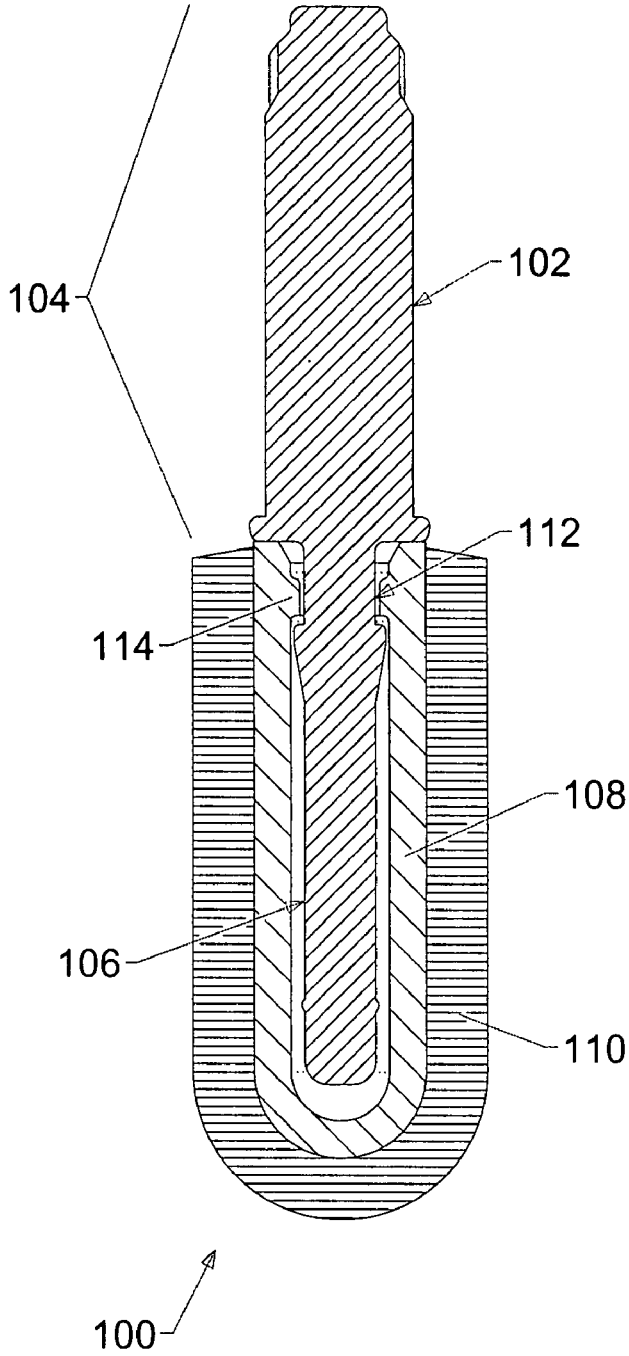
Figure 28A:
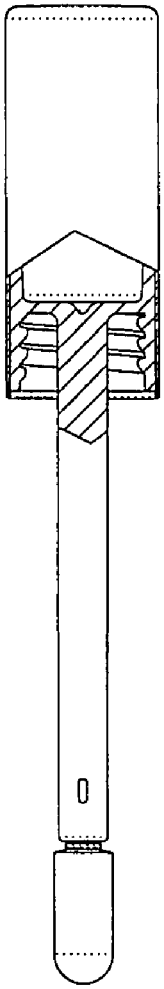
FIGS. 28*a* and 28*b* are partial sectional side views of a cosmetic brush and container, respectively, embodying the present invention in a particular form showing a hollow core with flocking which can rotate about the longitudinal axis of the core.
Figure 28B:
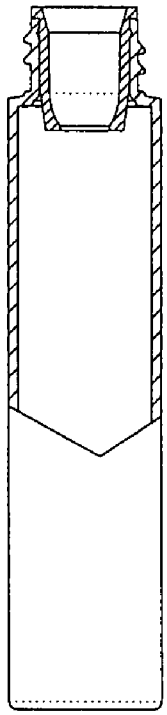
Figure 28C:
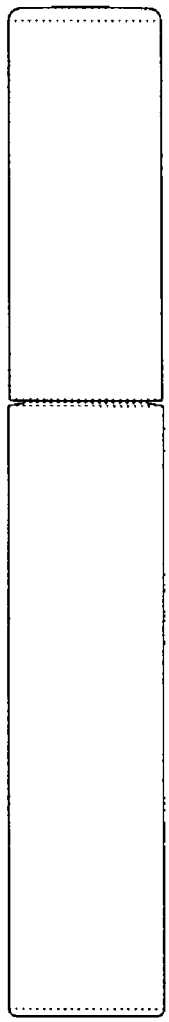
FIGS. 28*c* and 28*d* are a side view and a top view, respectively, of a cosmetic brush in a container embodying the present invention in a particular form.
Figure 28D:
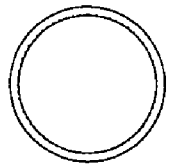
Figure 29A:
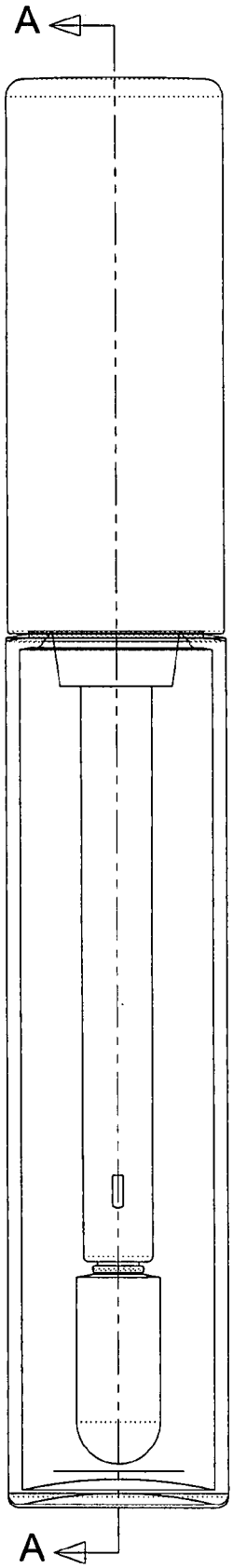
FIGS. 29*a* and 29*b* are a partial cut away front view and a cross-sectional side view along section line A, respectively, of a cosmetic brush embodying the present invention in a particular form showing a connector, a core with fiber, and a stem rod, each of the core and stem rod having an orifice for receiving an end of the connector.
Figure 29B:
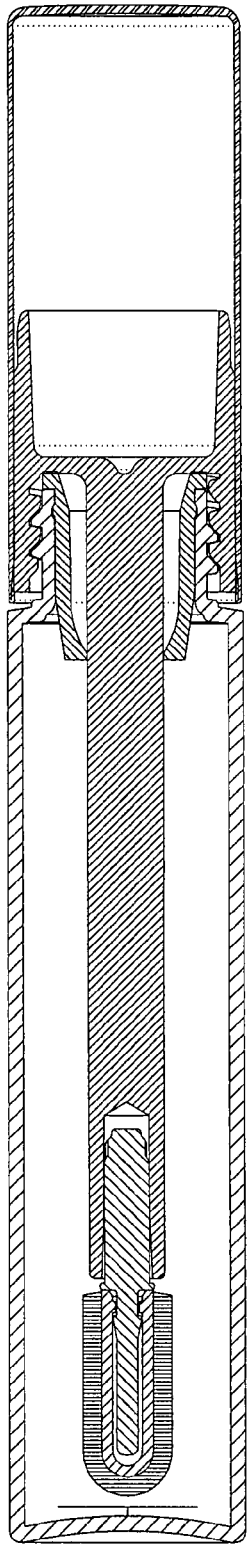
Figure 30:
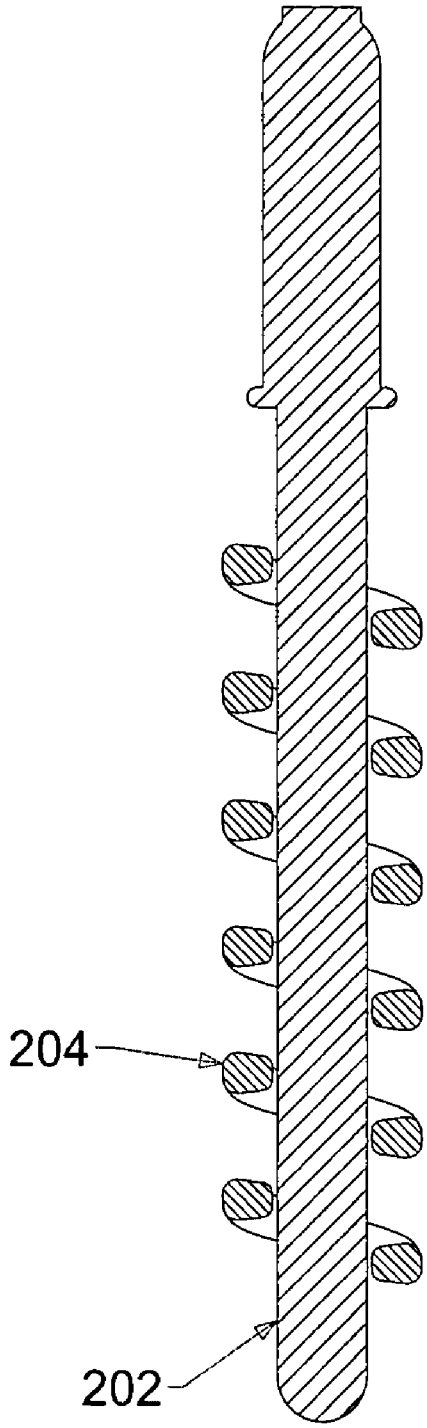
FIG. 30 is a cross-sectional view of an embodiment of the present invention showing a sleeve on the core.

In another embodiment of the present invention, as shown in FIGS. 12*a*-26*b*, the core 32 is not smoothly cylindrical but rather is shaped in various ways depending on the desired application. By shaping the core 32, the notional envelope formed by fiber array 36 will take on approximately the same shape as the core. For example, in FIGS. 12*a* and 12*b*, the core 32 is curved at the distal end along its longitudinal axis and the flocking takes on this shape as well. Such a curved distal end is useful when the cosmetic product is to be applied to a curved surface such as a user's eyelashes.

FIGS. 27*a*-28*b* show a flocked brush 100 that can be rotatably attached to a handle. In this embodiment, a connector 102 has a proximate end 104 which is provided to attach to the handle or a stem rod, and a distal end 106 to attach to a hollow core 108 by insertion into the inner hollow portion of the core, such that the core is free to rotate about the longitudinal axis of the core 102. In one embodiment, the rotation is permitted by a circumferential track 112 in the connector 102 into which a guide 114 on the inside of the core 108 fits. In operation, the guide 114 rotates in the track 112 carrying the rest of the core and the adhered flocking about the longitudinal axis of the core 102.

These rotatable brushes allow a user to utilize all surfaces of the fiber array without requiring the user to manually rotate the brush, since proper rotation of a fixed brush held between a user's thumb and forefinger can be difficult.

A particular advantage of the brush of the present invention is that numerous fiber array patterns can be easily created. Additionally, fiber arrays with two different types of fibers, arranged in diverse patterns can be efficiently produced.

Figure 37:
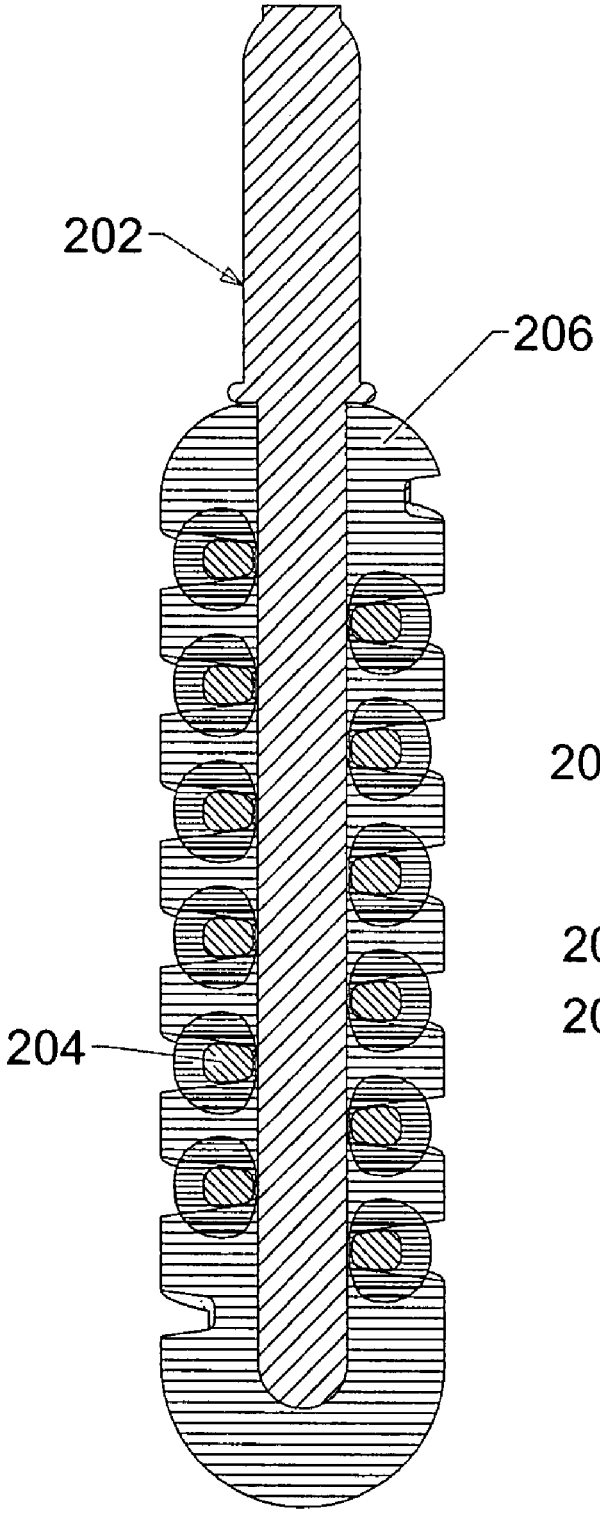
FIG. 37 is a cross-sectional view of a cosmetic brush embodying the present invention in a particular form showing a sleeve, which is flocked, placed over a flocked core.
Figure 38:
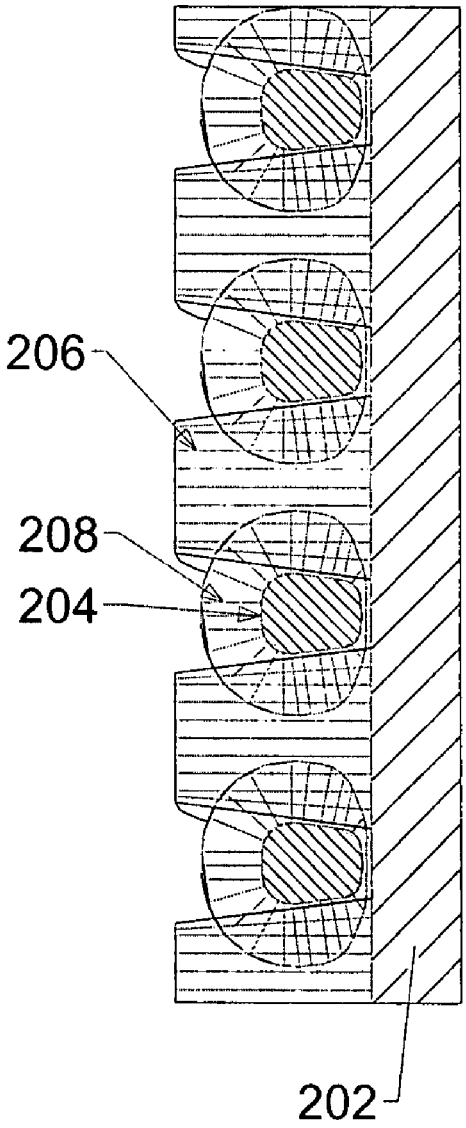
FIG. 38 is an enlargement of the cross-sectional view of the cosmetic brush shown in FIG. 37 showing a sleeve, which is flocked, placed over a flocked core.

Sleeves 204 with flocking 208 or bristles 210 are not limited to the embodiments discussed above with respect to FIGS. 31, 32, 33, and 34. For example, unlike the embodiment shown in FIGS. 33 and 34 in which the flocking is only applied to one or more portions of a sleeve 204, such as the outwardly facing flat side 212 of the sleeve 204, FIGS. 37 and 38 illustrate an embodiment in which flocking 208 is applied all around the sleeve 204. Also, the sleeves need not have a flat side 212 as shown in FIGS. 33 and 34, but can have any cross-section including the round cross-section shown in FIGS. 37 and 38.

Figure 41A:
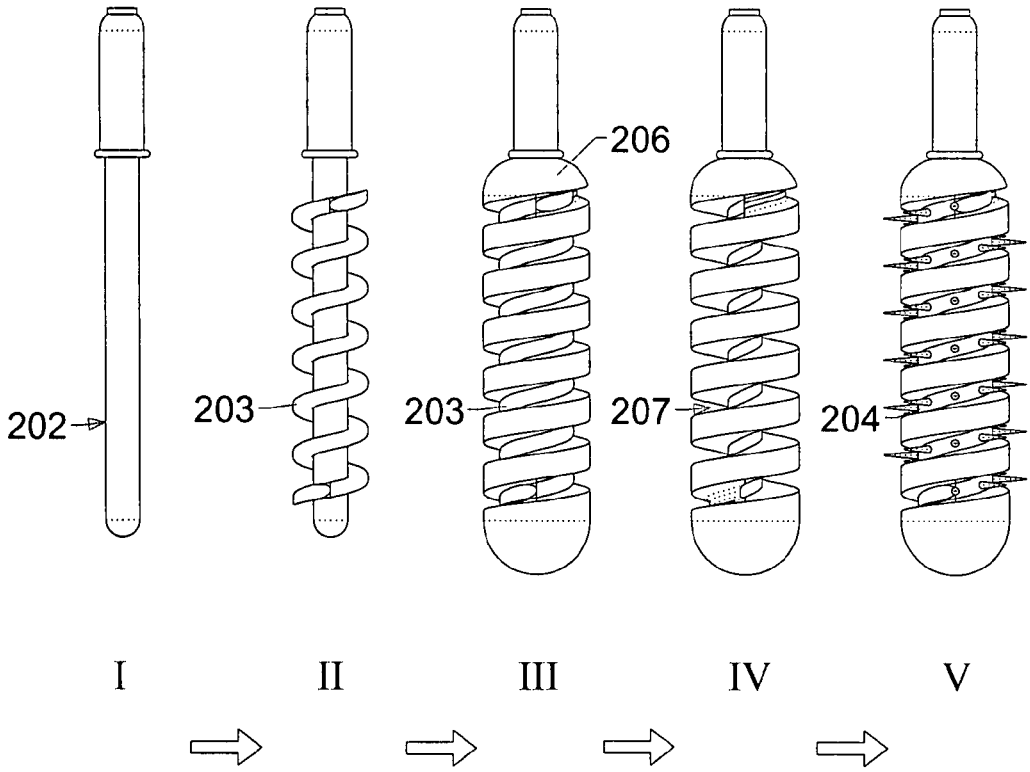
FIGS. 41*a*I, 41*a*II, 41*a*III, 41*a*IV, and 41*a*V are front views illustrating a process embodying the present invention in a particular form for producing a cosmetic brush having a sleeve with bristles placed over a flocked core with voids.
Figure 41B:
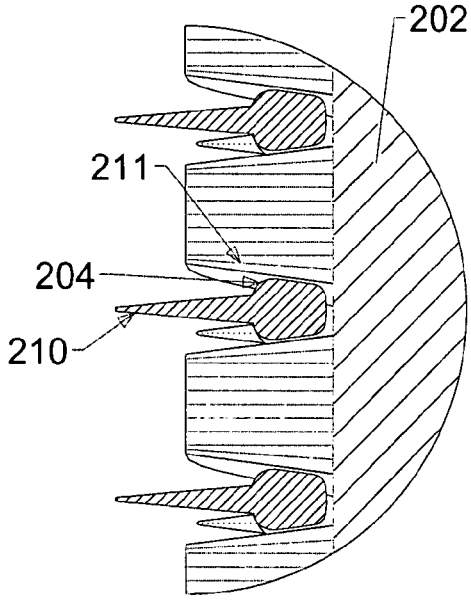
FIG. 41*b* is an enlargement of a cross-sectional view of the cosmetic brush embodying the present invention in a particular form produced by the process shown in FIGS. 41*a*I, 41*a*II, 41*a*III, 41*a*IV, and 41*a*V.

An exemplary process for obtaining the embodiments shown in FIGS. 31-34 and 41*b*, is illustrated in FIGS. 41*a*I, 41*a*II, 41*a*III, 41*a*IV, and 41*a*V. In this process, a mask 203 is placed over an unflocked core 202. Flocking 206 is then applied to the unmasked sections of the core 202, and the mask 203 is then removed. A sleeve 204 which, in this example, was formed with bristles 210, is then placed over the unflocked portions of the core 202.

Figure 40A:
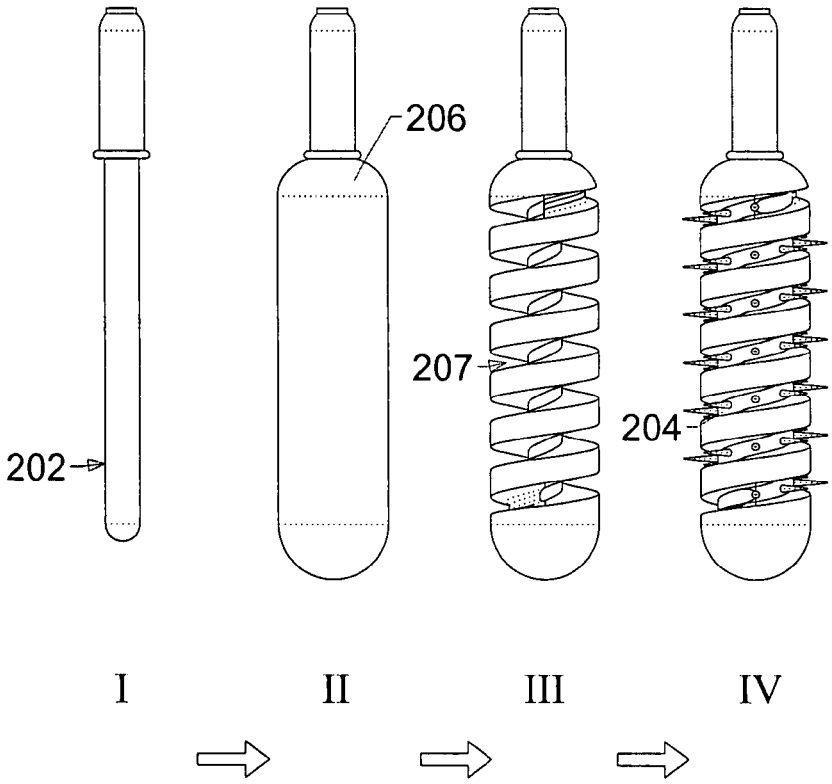
FIGS. 40*a*I, 40*a*II, 40*a*III, and 40*a*IV are front views illustrating a process embodying the present invention in a particular form for producing a cosmetic brush having a sleeve with bristles placed over a flocked core with voids.
Figure 40B:
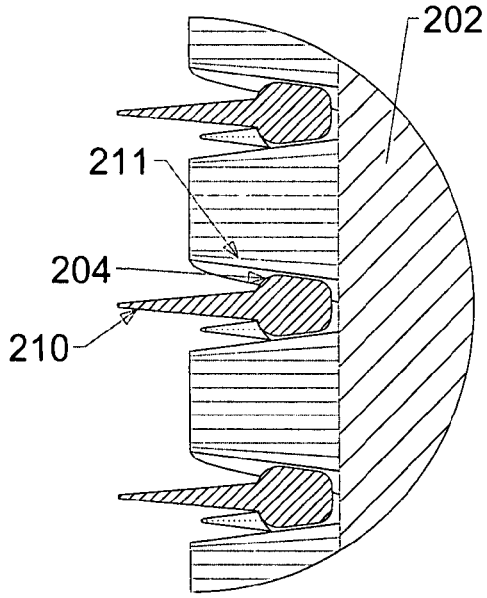
FIG. 40*b* is an enlargement of a cross-sectional view of a cosmetic brush embodying the present invention produced by the process shown in FIGS. 40*a*I, 40*a*II, 40*a*III, and 40*a*IV.

FIGS. 40*a*I-40*a*IV and 40*b* illustrate an alternative process by which voids are created by trimming a flocked core. This process involves, for example, starting with a core 202, applying flocking 206 to the core to create a core without voids, trimming the flocking to create voids 207, and then placing or injection molding a sleeve 204, which is formed with bristles 210, over the flocked core.

Figure 39A:
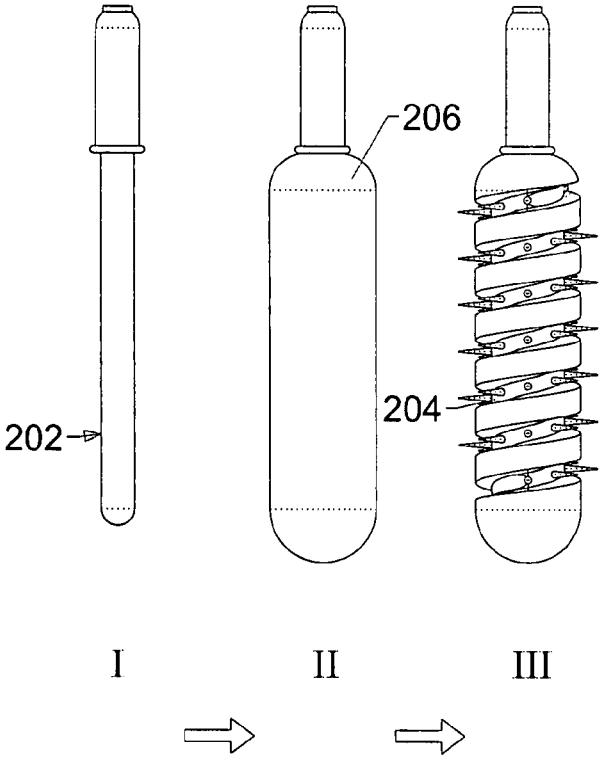
FIGS. 39*a*I, 39*a*II, and 39*a*III are front views illustrating a process embodying the present invention in a particular form for producing a cosmetic brush having a flocked core enclosed in a sleeve with bristles.
Figure 39C:
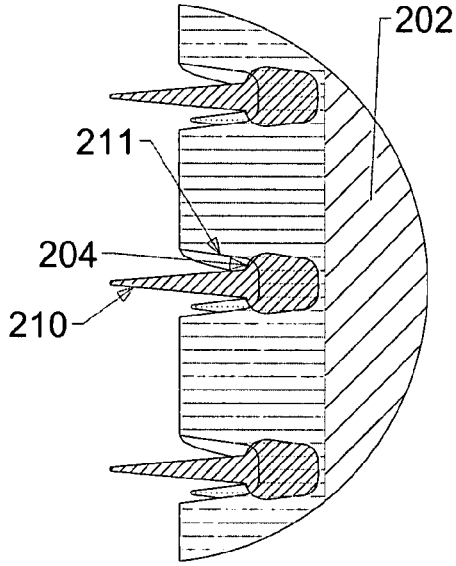
FIG. 39*c* is an enlargement of a cross-sectional view of a cosmetic brush embodying the present invention in which a sleeve with bristles is injection molded over a flocked core.
Figure 39B:
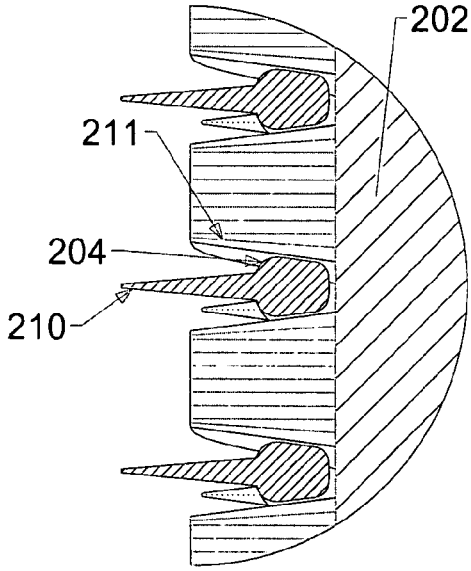
FIG. 39*b* is an enlargement of a cross-sectional view of a cosmetic brush embodying the present invention in which a sleeve with bristles is placed over a flocked core.

While the brushes with sleeves 204 shown in FIGS. 31, 32, 33 and 34, which can be formed by the process illustrated in FIGS. 41*a*I-41*a*V, are fitted into voids 207 of a flocked core, the sleeves 204 can also be placed over a flocked core so as to compress or redirect the flocking 206 of the core. FIGS. 39*a*I-39*a*III illustrate such a process. This process involves, for example, starting with a core 202, applying flocking 206 to the core to create a core without voids, and then placing or injection molding a sleeve 204, which is formed with bristles 210, over the flocked core. FIG. 39*b* illustrates a sleeve 204 placed over the flocked core and FIG. 39*c* illustrates a sleeve 204 injection molded over the flocked core in accordance with this process. Both these brushes can have regions 211 of compressed or redirected core flocking. In some embodiments, this process obviates the need to create voids before placing the sleeve over the flocked core.

In another embodiment of the present invention, even if the core 202 is formed with bristles 210, flocking 205 can still be applied. In the embodiment shown in FIGS. 48*a*, 48*b*, 48*c*, 48*d*, and 48*e*, one or more longitudinal spaces 213 are provided between the rows of bristles 210 to which flocking 205 can be applied. In this embodiment, the bristles 210 are molded with or attached to the core 202, and then the flocking 205 is applied to the spaces 213 between the bristles using masks or by painting adhesive and applying flocking to the spaces. If desired, flocking 205 can also be applied to the bristles 210.

The numerous new arrays of fibers can also be incorporated into traditional wire and bristle mascara brushes. For example, fibers can also be flocked onto the voids found in traditional wire core mascara brushes or directly onto the bristles of such brushes to provide new functionality and a more pleasant sensation when applying mascara. In a similar manner, stiffer fibers, such as the bristles found in conventional mascara brushes, can be flocked onto regions of previously flocked brushes to provide additional functionality in applying cosmetic materials. Furthermore, while the embodiments described above have been described with a brush having a core 202 with a continuous surface, this invention also applies to twisted wire brushes.

Figure 42:
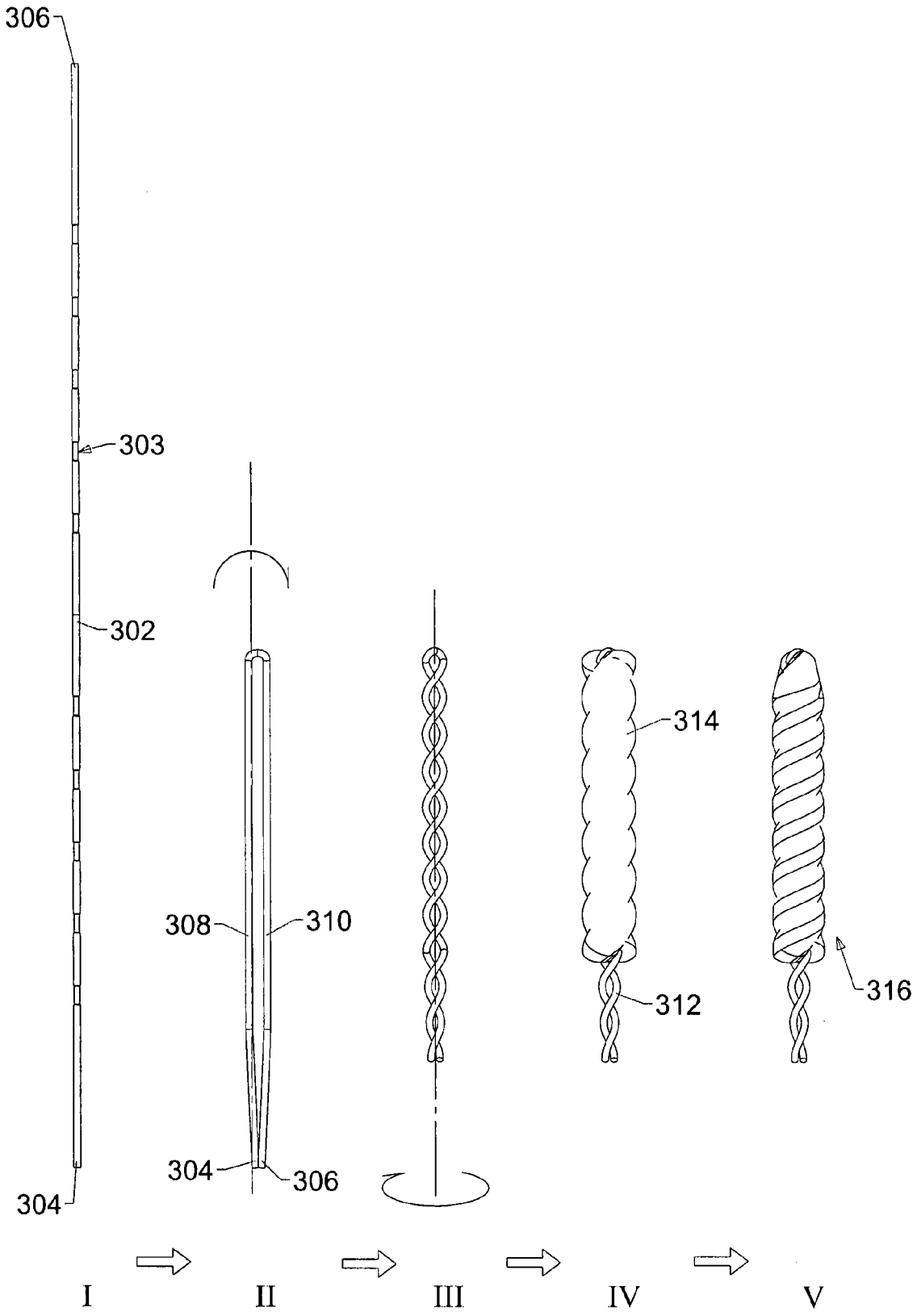
FIGS. 42I, 42II, 42III, 42IV, and 42V are front views illustrating a process embodying the present invention in a particular form for producing a cosmetic brush having a flocked twisted wire core.

FIGS. 42I, 42II, 42III, 42IV, and 42V illustrate a process for forming a twisted wire core and applying flocking to that core. The process starts with a length of wire 302 which can be made of any suitable material or materials, for example, metal, metal alloy, plastic, wood fibers, combinations thereof, etcetera. This wire 302 also can have indentations 303 for maintaining the distribution of the adhesive when the wire is twisted. The wire 302 is bent between the ends 304, 306 to create adjacent sides 308, 310. The adjacent sides 308, 310 of the wire 302 are then twisted about each other to form a twisted wire core 312. Flocking 314 is then applied to this twisted wire core 312, and the flocked twisted wire core 316 can be trimmed in a manner similar to the trimming of flocked continuous surface cores. As with the continuous surface cores, the twisted wire cores can also have masks applied during the flocking process.

However, because each side 308, 310 of the wire can be separately treated or formed before being twisted together, additional variations are possible with a twisted wire core 312.

Figure 43:
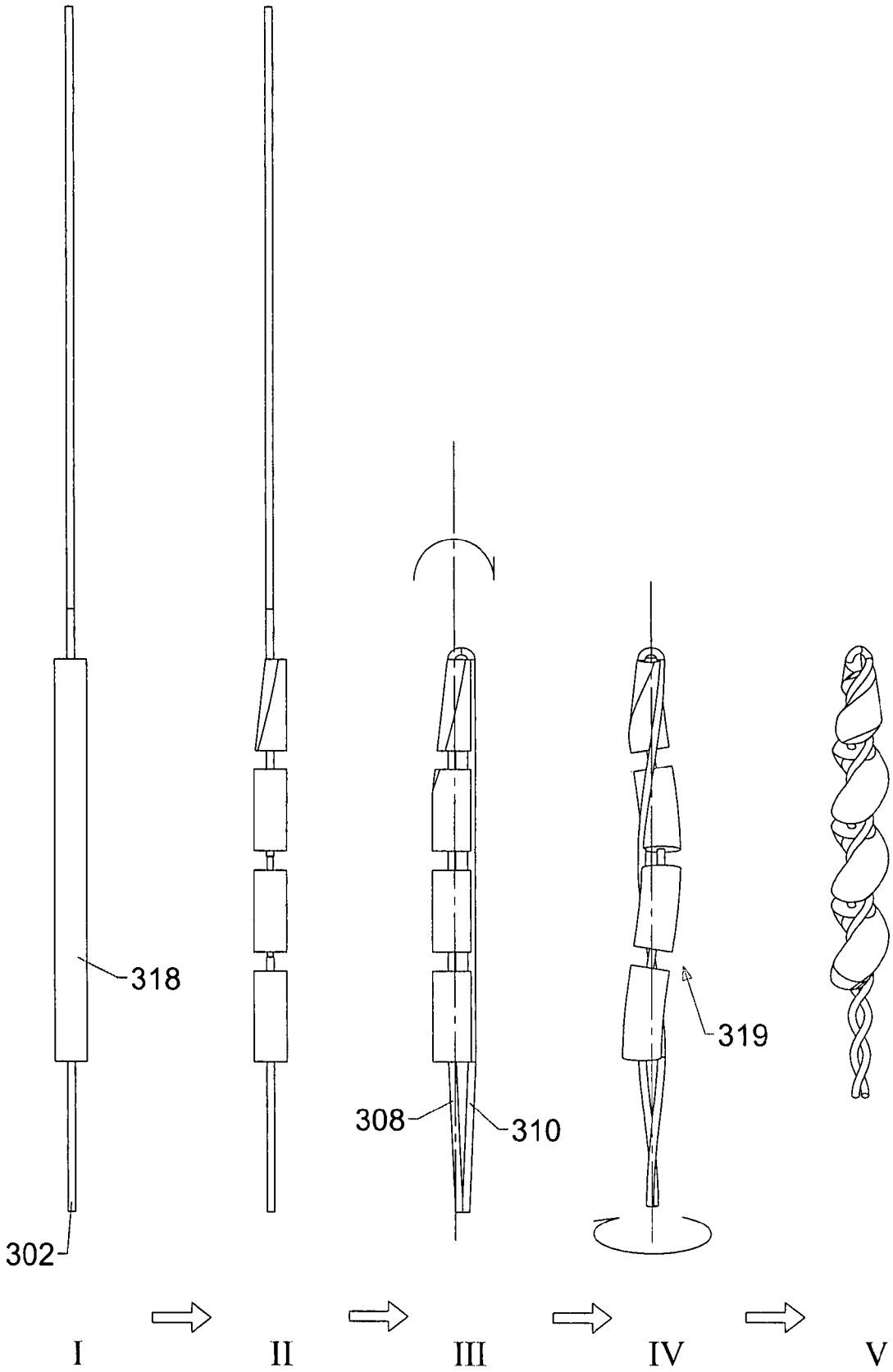
FIGS. 43I, 43II, 43III, 43IV, and 43V are front views illustrating a process embodying the present invention in a particular form for producing a cosmetic brush having a flocked twisted wire core in which at least a portion of the wire is flocked before the twisting of the wire.

For example, FIGS. 43I, 43II, 43III, 43IV and 43V illustrate a process for forming one such twisted wire core embodiment of this invention. Like the embodiment described above, this process starts with a length of wire 302. However, unlike that embodiment, at least a portion of the wire 302 is flocked before being bent to form the two adjacent sides 308, 310. Further, this flocking 318 can be trimmed longitudinally, transversely, obliquely, or in other ways before being bent, see FIG. 43II, and/or before being twisted, see FIG. 43III. After this trimming or trimmings the adjacent sides 308, 310 are twisted together, see FIGS. 43IV and 43V, to form a partially flocked twisted wire core 319. Additional trimming can be performed and/or additional flocking can be added after the twisting.

Figure 44:
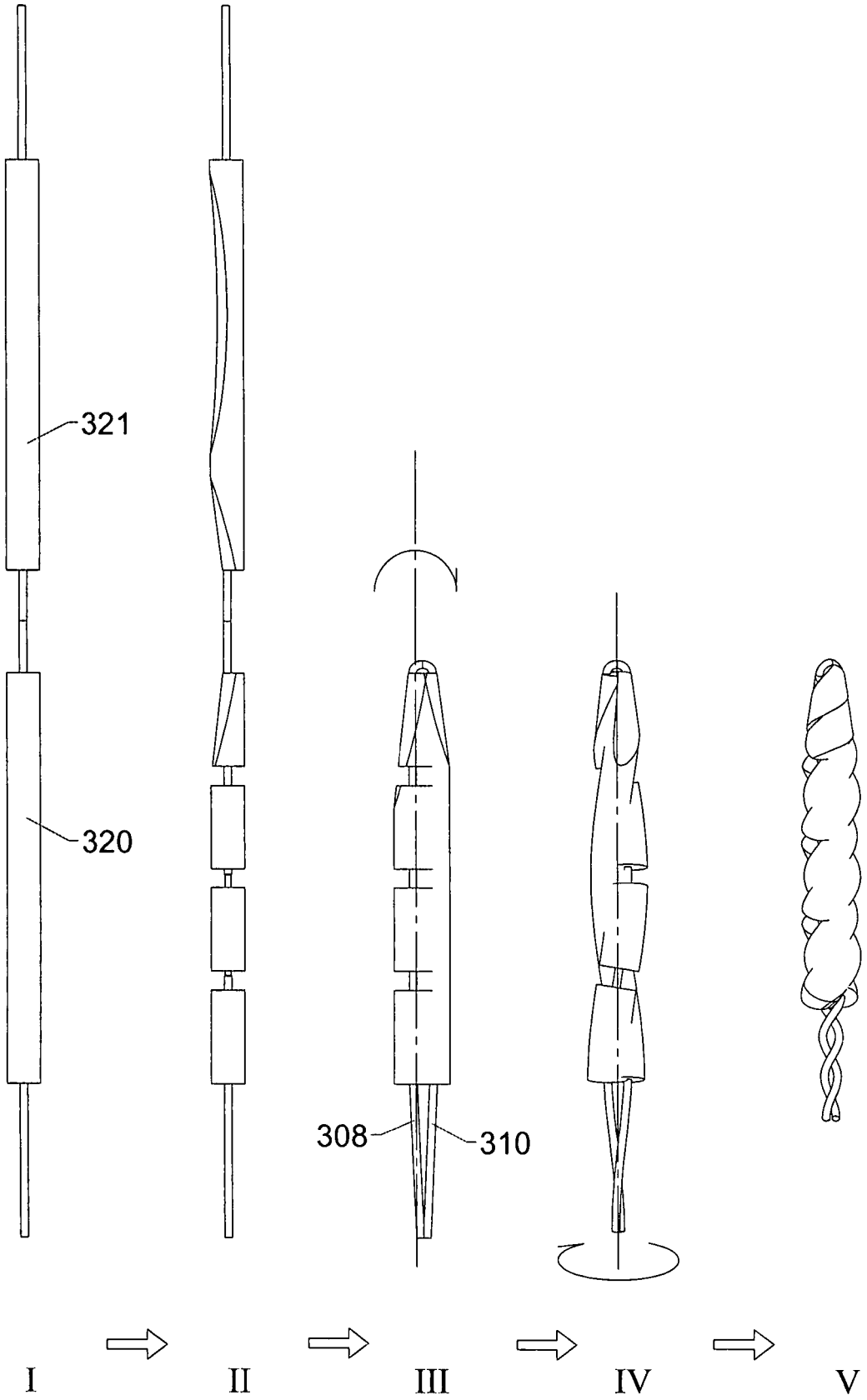
FIGS. 44I, 44II, 44III, 44IV, and 44V are front views illustrating a process embodying the present invention in a particular form for producing a cosmetic brush having a flocked twisted wire core in which at least two portions of the wire are flocked before the twisting of the wire.

FIGS. 44I, 44II, 44III, 44IV and 44V illustrate another exemplary process for forming another twisted wire core embodiment of this invention. In this embodiment, instead of flocking being applied to only one of the adjacent sides 308, 310, flocking 320, 321 is applied to both sides and, accordingly, each side 308, 310 can be trimmed before being bent and/or twisted.

Figure 45:
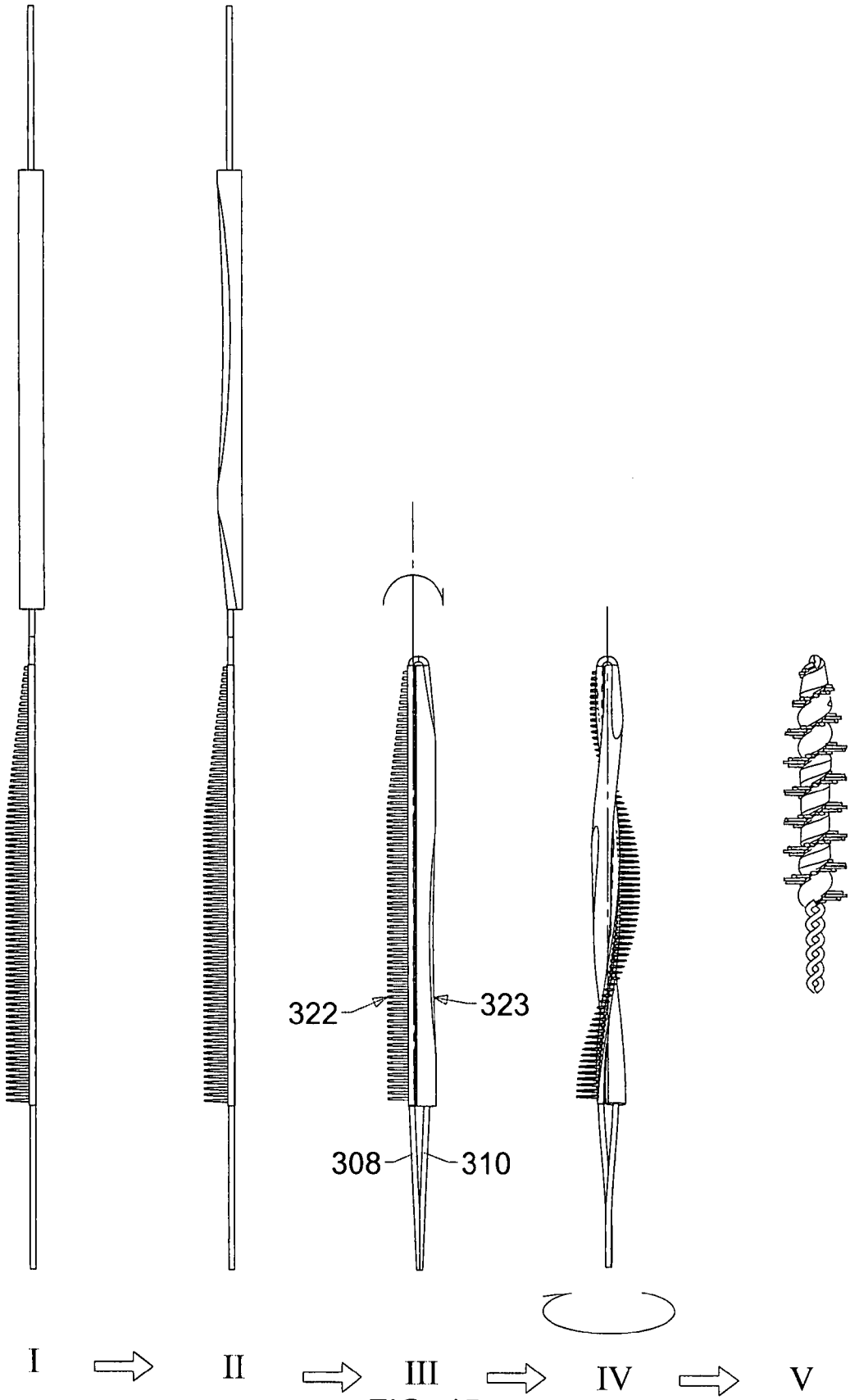
FIGS. 45I, 45II, 45III, 45IV, and 45V are front view illustrating a process embodying the present invention in a particular form for producing a cosmetic brush having a flocked twisted wire core in which one portion of the wire is flocked and another portion of the wire is formed with bristles before the twisting of the wire.

FIGS. 45I, 45II, 45III, 45IV and 45V, illustrate another exemplary process for forming yet another twisted wire core embodiment of this invention. In this embodiment, one side of the wire 308 is formed with bristles 322 while the other side 310 has flocking 323 applied.

Figure 46:
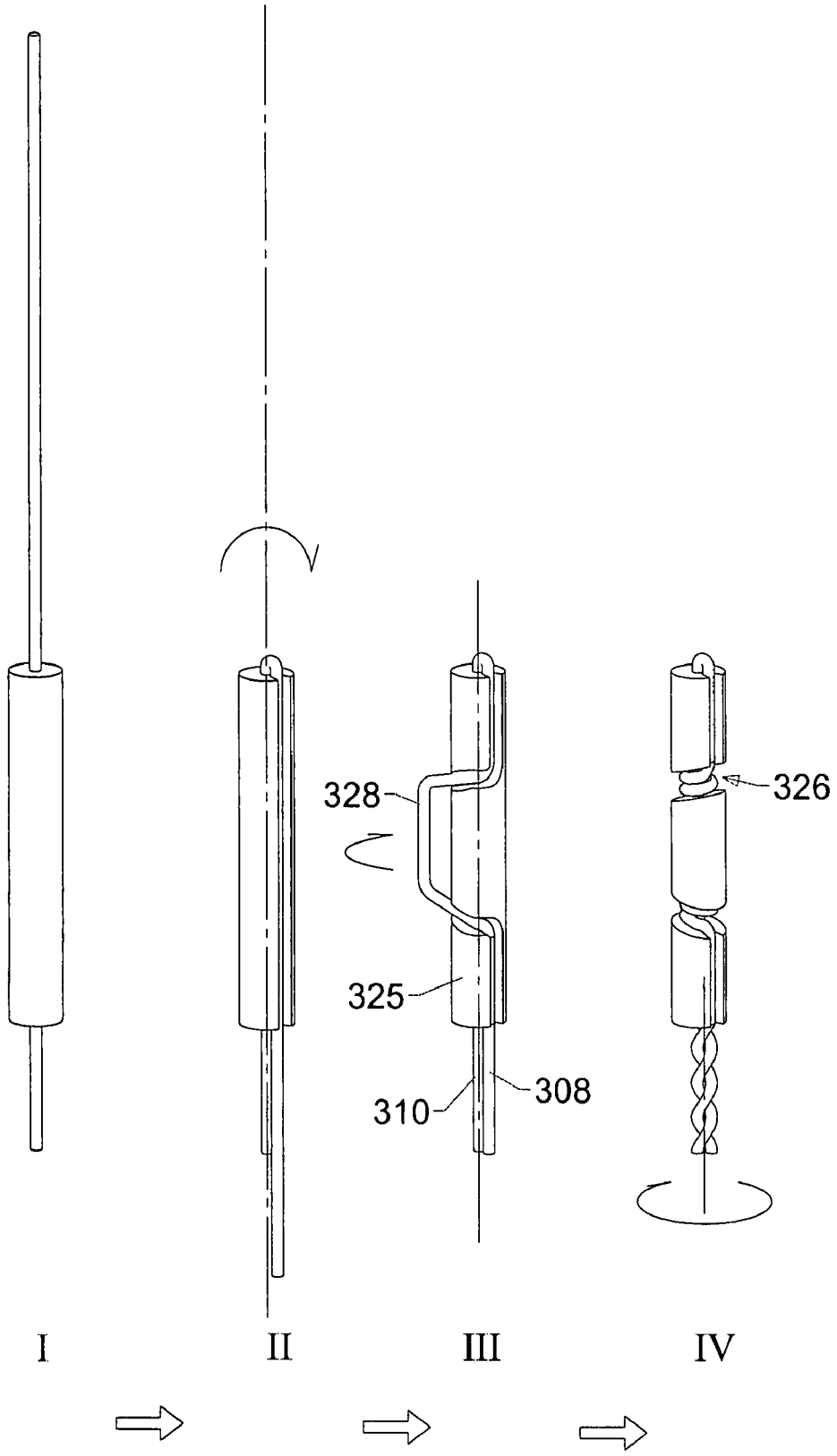
FIGS. 46I, 46II, 46III, and 46IV are perspective views illustrating a process embodying the present invention in a particular form for producing a cosmetic brush having a flocked twisted wire core in which one portion of the wire is flocked and another portion of the wire is twisted so as to create indentations in the flocking of a twisted wire core when the portions are twisted together.
Figure 47:
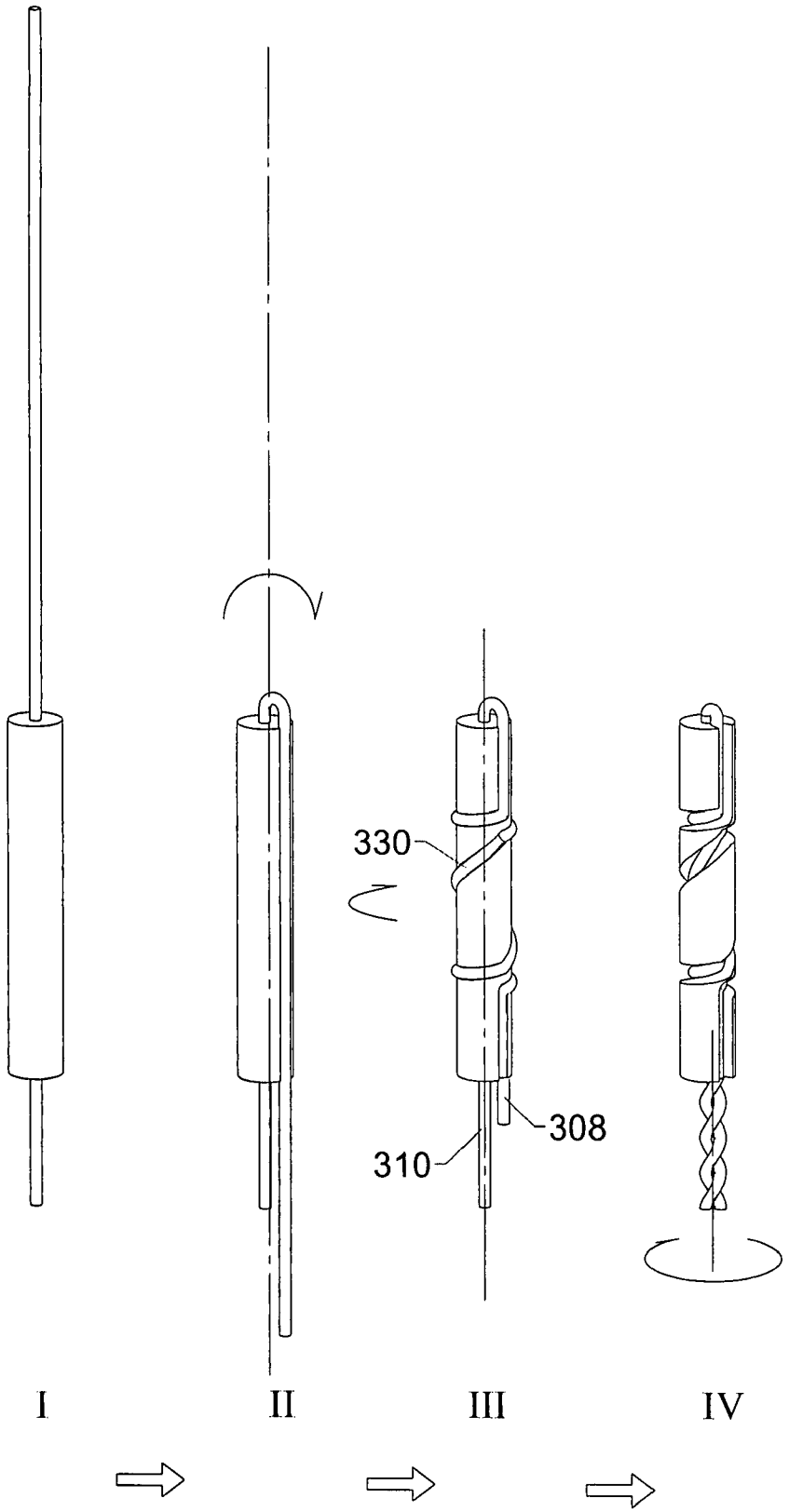
FIGS. 47I, 47II, 47III, and 47IV are perspective views illustrating a process embodying the present invention in another particular form for producing a cosmetic brush having a flocked twisted wire core in which one portion of the wire is flocked and another portion of the wire is twisted to create indentations in the flocking of a twisted wire core when the portions are twisted together.
Figure 48A:
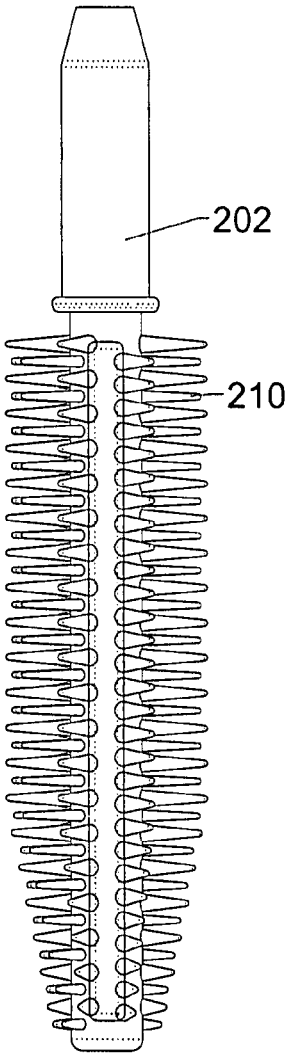
FIGS. 48*a*, 48*b*, 48*c*, 48*d*, and 48*e* are respective front, side, cross-sectional, isometric and top views of a cosmetic brush embodying the present invention in a particular form showing a core having longitudinal bristles and flocking.
Figure 48B:
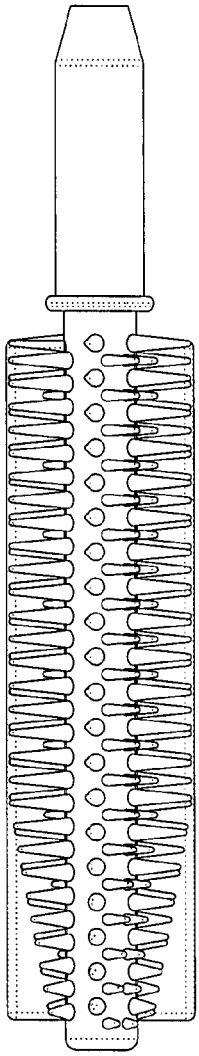
Figure 48C:
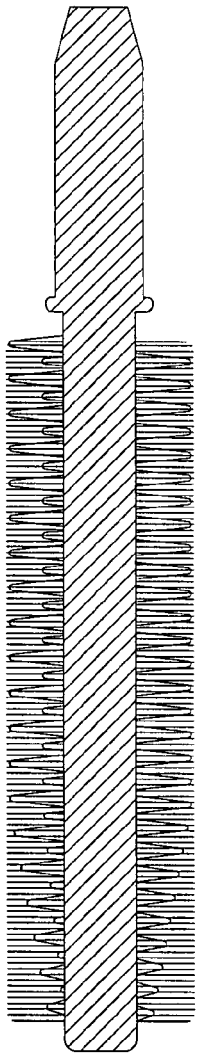
Figure 48D:
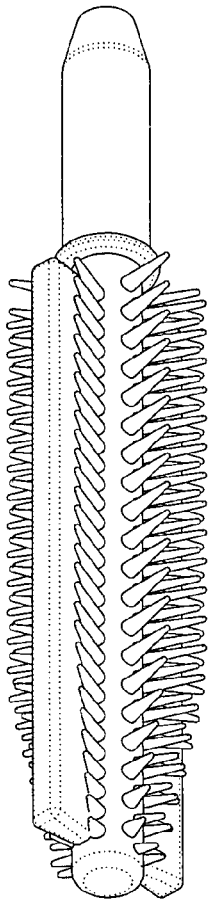
Figure 48E:
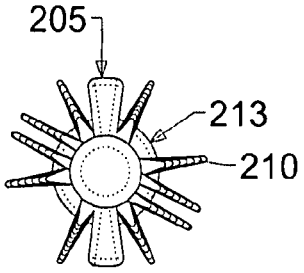

FIGS. 46I, 46II, 46III, and 46IV illustrate another exemplary process for forming a further twisted wire core embodiment of the invention. In this embodiment, one of the sides 308 acts as a sleeve for compressing the flocking 325 on the other side 310. The pattern of void-like indentations 326, that is where one side 308 compresses the other side 310, can be varied by bending the compressing side 308 into certain shapes before being twisted. For example, in FIG. 46II, the compressing side 308 is first formed into a rectangular-like bend 328, and then is twisted about the other side 308, see FIGS. 46III and 46IV, to create the desired pattern. FIGS. 47I, 47II, 47III, and 47IV illustrate a similar process in which the shape of the compressing side 308 is a spiral 330.

It is to be understood that the invention is not limited to the features and embodiments hereinabove specifically set forth, but may be carried out in other ways without departure from its spirit.

What is claimed is:

1. A mascara dispenser comprising:

(a) a container holding a quantity of mascara and having an opening;

(b) a removable cap for closing the opening; and (c) an applicator carried by the cap so as to be inserted into mascara in the container when the cap closes the opening, and to be withdrawn from the container, bearing mascara, when the cap is removed from the container, for transporting mascara from the container and depositing mascara on a user's eyelashes with the cap serving as a handle for the applicator, said applicator comprising:

(i) an elongated core;

(ii) a flocking of first fibers adhered to two or more first portions of the core; and (iii) a flocking of second fibers adhered to two or more second portions of the core separate from the two or more first portions of the core, wherein:

the first fibers have a first length, the second fibers have a second length shorter than the first length, and the two or more first portions and two or more second portions are arranged on the core so as to define a shaped profile having two or more longitudinal voids each extending along a whole length of the applicator, the two or more longitudinal voids being regularly spaced from one another and aligned along a longitudinal axis of the elongated core and separated by at least one of the first portions.

2. A cosmetic applicator comprising:

(a) a core;

(b) a flocking of first fibers adhered to two or more first portions of the core; and (c) a flocking of second fibers adhered to two or more second portions of the core separate from the two or more first portions of the core, wherein:

the first fibers have a first length, the second fibers have a second length shorter than the first length, and the two or more first portions and two or more second portions are arranged on the core so as to define a shaped profile having two or more longitudinal voids each extending along a whole length of the applicator, the two or more longitudinal voids being regularly spaced from one another and aligned along a longitudinal axis of the elongated core and separated by at least one of the first portions.

3. The cosmetic applicator of claim 2, wherein the shaped profile comprises one or more grooves.

4. The cosmetic applicator of claim 2, wherein the flocking comprises one or more linear mass densities below or equal to about 300 grams/10,000 meters.

5. The cosmetic applicator of claim 4, wherein the flocking comprises one or more linear mass densities in the range from about 6 grams/10,000 meters to about 30 grams/10,000 meters.

6. The cosmetic applicator of claim 2, wherein the flocking comprises fibers having lengths below or equal to about 50.0 millimeters.

7. The cosmetic applicator of claim 6, wherein the flocking comprises fibers having lengths in the range of about 1.0 millimeter to about 4.0 millimeters.

8. The cosmetic applicator of claim 2, wherein the core rotatably connects to a handle.

9. The mascara dispenser of claim 1, wherein the number of longitudinal voids is two.

10. The mascara dispenser of claim 1, wherein the number of longitudinal voids is three.

11. The mascara dispenser of claim 1, wherein the number of longitudinal voids is four.

12. The cosmetic applicator of claim 2, wherein the number of longitudinal voids is two.

13. The cosmetic applicator of claim 2, wherein the number of longitudinal voids is three.

14. The cosmetic applicator of claim 2, wherein the number of longitudinal voids is four.

* * * * *